US010178742B2

(12) United States Patent
Choi

(10) Patent No.: US 10,178,742 B2
(45) Date of Patent: Jan. 8, 2019

(54) LED DRIVING APPARATUS AND LIGHTING APPARATUS

(71) Applicant: SAMSUNG ELECTRONICS CO., LTD., Suwon-si (KR)

(72) Inventor: Seung Kwan Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/221,709

(22) Filed: Jul. 28, 2016

(65) Prior Publication Data

US 2017/0202062 A1 Jul. 13, 2017

(30) Foreign Application Priority Data

Jan. 13, 2016 (KR) ..... 10-2016-0004021

(51) Int. Cl.
*G06F 11/30* (2006.01)
*H05B 37/02* (2006.01)
*H05B 33/08* (2006.01)

(52) U.S. Cl.
CPC ..... *H05B 37/0272* (2013.01); *H05B 33/0854* (2013.01); *H05B 37/0254* (2013.01)

(58) Field of Classification Search
CPC ..... H05B 33/0815; H05B 33/0851; H05B 33/0818; H05B 33/0845; H05B 33/0848; H05B 37/029; H05B 33/0803; H05B 33/0824; H05B 33/0842; H05B 33/0866; H05B 37/02
USPC ..... 315/291, 307, 224, 219, 247, 308, 297, 315/246, 312, 209 R
See application file for complete search history.

(56) References Cited

U.S. PATENT DOCUMENTS 6,372,608 B1 4/2002 Shimoda et al.
6,645,830 B2 11/2003 Shimoda et al.
RE38,466 E 3/2004 Inoue et al.
6,818,465 B2 11/2004 Biwa et al.
(Continued)

FOREIGN PATENT DOCUMENTS

JP 2008186615 A 8/2008
JP 201129194 A 2/2011
(Continued)

OTHER PUBLICATIONS

Title: Federal Energy Regulatory Commission Assessment of Demand Response & Advanced Metering, Date: Dec. 2008; Author: Federal Energy Regulatory Commission.*

*Primary Examiner* — Wei Chan
(74) *Attorney, Agent, or Firm* — Sughrue Mion, PLLC

(57) ABSTRACT

A light emitting diode (LED) driving apparatus includes: a first circuit connected to a primary winding of a transformer, and configured to receive input power and transfer the input power to the primary winding of the transformer; a second circuit connected to a secondary winding of the transformer to generate output power for driving a plurality of LEDs; and a controller including a control circuit configured to control the second circuit, and a power detection circuit configured to compare a magnitude of the input power with a predetermined reference power magnitude range, and transmit a control command to the control circuit in response to determining that the magnitude of the input power is outside the predetermined reference power magnitude range.

15 Claims, 15 Drawing Sheets

(56) References Cited

U.S. PATENT DOCUMENTS 6,818,530 B2 11/2004 Shimoda et al.
6,858,081 B2 2/2005 Biwa et al.
6,967,353 B2 11/2005 Suzuki et al.
7,002,182 B2 2/2006 Okuyama et al.
7,084,420 B2 8/2006 Kim et al.
7,087,932 B2 8/2006 Okuyama et al.
7,141,938 B2 11/2006 Buij et al.
7,154,124 B2 12/2006 Han et al.
7,208,725 B2 4/2007 Sherrer et al.
7,288,758 B2 10/2007 Sherrer et al.
7,319,044 B2 1/2008 Han et al.
7,501,656 B2 3/2009 Han et al.
7,709,857 B2 5/2010 Kim et al.
7,747,357 B2 * 6/2010 Murdoch ..... H02J 3/00 340/12.32
7,759,140 B2 7/2010 Lee et al.
7,781,727 B2 8/2010 Sherrer et al.
7,790,482 B2 9/2010 Han et al.
7,940,350 B2 5/2011 Jeong
7,959,312 B2 6/2011 Yoo et al.
7,964,881 B2 6/2011 Choi et al.
7,985,976 B2 7/2011 Choi et al.
7,994,525 B2 8/2011 Lee et al.
8,008,683 B2 8/2011 Choi et al.
8,013,352 B2 9/2011 Lee et al.
8,049,161 B2 11/2011 Sherrer et al.
8,076,953 B2 12/2011 Snelten
8,129,711 B2 3/2012 Kang et al.
8,179,938 B2 5/2012 Kim
8,248,271 B2 8/2012 Ghanem et al.
8,263,987 B2 9/2012 Choi et al.
8,274,237 B2 9/2012 Nagase et al.
8,324,646 B2 12/2012 Lee et al.
8,399,944 B2 3/2013 Kwak et al.
8,432,511 B2 4/2013 Jeong
8,459,832 B2 6/2013 Kim
8,502,242 B2 8/2013 Kim
8,536,604 B2 9/2013 Kwak et al.
8,735,931 B2 5/2014 Han et al.
8,766,295 B2 7/2014 Kim
2002/0194547 A1 * 12/2002 Christensen ..... G06F 11/0736 714/43
2008/0088180 A1 * 4/2008 Cash ..... H02J 3/14 307/31
2009/0315480 A1 * 12/2009 Yan ..... H05B 33/0815 315/297
2010/0164403 A1 * 7/2010 Liu ..... H05B 33/086 315/297
2011/0085816 A1 * 4/2011 Kim ..... G03G 15/5004 399/88
2012/0091804 A1 * 4/2012 Altonen ..... E06B 9/68 307/31
2013/0026936 A1 * 1/2013 Zhang ..... H05B 41/38 315/206
2013/0093327 A1 4/2013 Lee
2014/0176008 A1 * 6/2014 Harish Gopala Pillai ..... H05B 33/0809 315/291
2014/0265880 A1 * 9/2014 Taipale ..... H05B 37/0263 315/158
2014/0265935 A1 * 9/2014 Sadwick ..... H05B 33/0815 315/307
2014/0354170 A1 * 12/2014 Gredler ..... H05B 33/0815 315/224
2015/0061503 A1 * 3/2015 Billard ..... H05B 37/0272 315/149
2015/0286158 A1 10/2015 Ohta et al.

FOREIGN PATENT DOCUMENTS

KR 101155046 B1 6/2012
KR 101199034 B1 11/2012
KR 101364850 B1 2/2014

* cited by examiner

LED DRIVING APPARATUS AND LIGHTING APPARATUS

CROSS-REFERENCE TO THE RELATED APPLICATION

This application claims benefit of priority of Korean Patent Application No. 10-2016-0004021 filed on Jan. 13, 2016 in the Korean Intellectual Property Office, the disclosure of which is incorporated herein by reference in its entirety.

BACKGROUND

Apparatuses consistent with example embodiments of the inventive concept relate to a light emitting diode (LED) driving apparatus and a lighting apparatus.

Semiconductor light emitting devices commonly include devices such as LEDs and the like, and such semiconductor light emitting devices have several advantages, such as low power consumption, high brightness, long service life, and the like, and thereby the range of uses thereof as light sources has been increasingly expanded. Such semiconductor light emitting devices may have applications in various fields as light sources, and have been widely employed in lighting apparatuses which have replaced existing fluorescent lamps and incandescent lamps in recent years.

Various technologies controlling a lighting apparatus adopting a semiconductor light emitting device using wired/wireless communications have been proposed. For implementing lighting control technology based on wired or wireless communications, a lighting apparatus may provide a failure determination function for a semiconductor light emitting device employed as a light source therein, a function of determining whether an abnormality is present in input/output power, or the like.

SUMMARY

Example embodiments of the inventive concept provide a light source (LED) driving apparatus and a lighting apparatus, capable of determining whether a failure, a normal operation, or the like, has occurred in the light source by detecting a magnitude of input power to implement lighting control, and providing a power consumption monitoring function for a user via wired/wireless communications.

According to an example embodiment, there is provided a light source driving apparatus which may include: a first circuit configured to receive and transfer an input power to a transformer; a second circuit connected to the transformer and configured to generate an output power for driving a light source based on the input power; and a controller configured to detect the input power and control the second circuit based on the detected input power.

According to an example embodiment, there is provided an LED driving apparatus which may include: a first circuit connected to a primary winding of a transformer, and configured to receive input power and transfer the input power to the primary winding of the transformer; a second circuit connected to a secondary winding of the transformer to generate output power for driving a plurality of LEDs; and a controller including a control circuit configured to control the second circuit, and a power detection circuit configured to compare a magnitude of the input power with a predetermined reference power magnitude range, and transmit a control command to the control circuit in response to the magnitude of the input power being outside the predetermined reference power magnitude range.

According to an example embodiment, there is provided an LED driving apparatus which may include: a first circuit connected to a primary winding of a transformer, and configured to receive input power and transfer the input power to the primary winding of the transformer; a second circuit connected to a secondary winding of the transformer and configured to generate output power for driving a plurality of LEDs; and a controller configured to determine a magnitude of the output power by controlling operations of the second circuit, and connected to an external lighting controller to communicate with the external lighting controller through a digital addressable lighting interface (DALI) communications protocol, wherein the controller generates information required for lighting control through the DALI communications protocol by comparing a magnitude of the input power with a predetermined reference power magnitude range, and transmits the information to the external lighting controller.

According to an example embodiment, there is provided a lighting apparatus which may include: a light source including a plurality of LEDs; a driving circuit including a transformer, a first circuit connected to a primary winding of the transformer, and a second circuit connected to a secondary winding of the transformer and isolated from the first circuit; and a controller configured to detect a magnitude of input power supplied to the first circuit and control output power supplied to the light source by the second circuit, wherein the controller includes an isolation circuit, a control circuit configured to control the second circuit, and a power detection circuit configured to compare the magnitude of the input power with a predetermined reference power magnitude and then generating a control command controlling the output power, and transmitting the control command to the control circuit through the isolation circuit.

BRIEF DESCRIPTION OF THE DRAWINGS

The above and other aspects, features and other advantages of the inventive concept will be more clearly understood from the following detailed description taken in conjunction with the accompanying drawings, in which.

DETAILED DESCRIPTION OF THE EXAMPLE EMBODIMENT

Hereinafter, example embodiments of the inventive concept will be described as follows with reference to the attached drawings.

Figure 1:
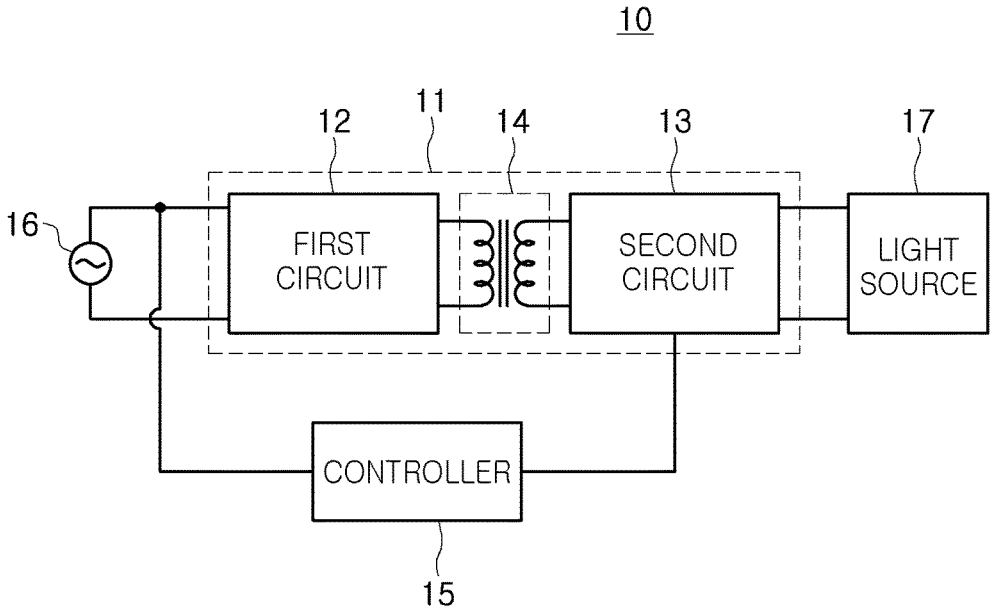
FIG. 1 is a block diagram illustrating a lighting apparatus, according to an example embodiment.

FIG. 1 is a block diagram which illustrates a lighting apparatus according to an example embodiment.

Referring to FIG. 1, a lighting apparatus 10, according to an example embodiment may include a driving circuit 11, a controller 15, and a light source 17. The driving circuit 11 may receive input power from a power supply 16, and the input power may be alternating current (AC) power. The driving circuit 11 may include a first circuit 12 connected to a primary winding of a transformer 14, and a second circuit 13 connected to a secondary winding of the transformer 14. The first circuit 12 and the second circuit 13 may be isolated from each other by the transformer 14.

The first circuit 12 may filter and rectify input power transferred from the power supply 16. Power output by the first circuit 12 is transferred to the second circuit 13 through the transformer 14, and the second circuit 13 may generate output power for driving a plurality of LEDs included in the light source 17. The second circuit 13 may include a direct current (DC)-DC converter, and may include a circuit, for example, a buck converter, a boost converter, or the like.

Although FIG. 1 illustrates that a single second circuit 13 is connected to a secondary winding of the transformer 14, by way of example, the lighting apparatus 10 may also be configured in a manner different therefrom. For example, in an example embodiment, the transformer 14 may include a plurality of secondary windings combined with a primary winding, and the plurality of secondary windings may be connected to different second circuits 13 and different light sources 17, respectively. For example, when the transformer 14 includes a plurality of secondary windings, a plurality of the second circuits 13 and a plurality of the light sources 17 may be provided, respectively.

The controller 15 may detect input power supplied to the first circuit 12 from the power supply 16, and also control output power supplied to the light source 17 from the second circuit 13. When the second circuit 13 includes a buck converter, a boost converter, or the like, output power may be controlled according to a switching frequency, a duty ratio, or the like of a switching device included in the second circuit 13. The controller 15 may include a microcontroller capable of controlling the switching frequency, the duty ratio, or the like of the switching device included in the second circuit 13.

The controller 15 may perform a communications function. In detail, the controller 15 may be connected to an external lighting controller via wired communications, thereby receiving a control command required for controlling the lighting apparatus 10 from the external lighting controller. In addition, the controller 15 may monitor a state of the lighting apparatus 10, and provide an external electronic device with a result of the monitoring via wireless communications. For example, a user may determine power consumption of the lighting apparatus 10, as well as whether a failure has occurred in the lighting apparatus 10, the light source 17, or the like, through the external electronic device.

Figure 2:
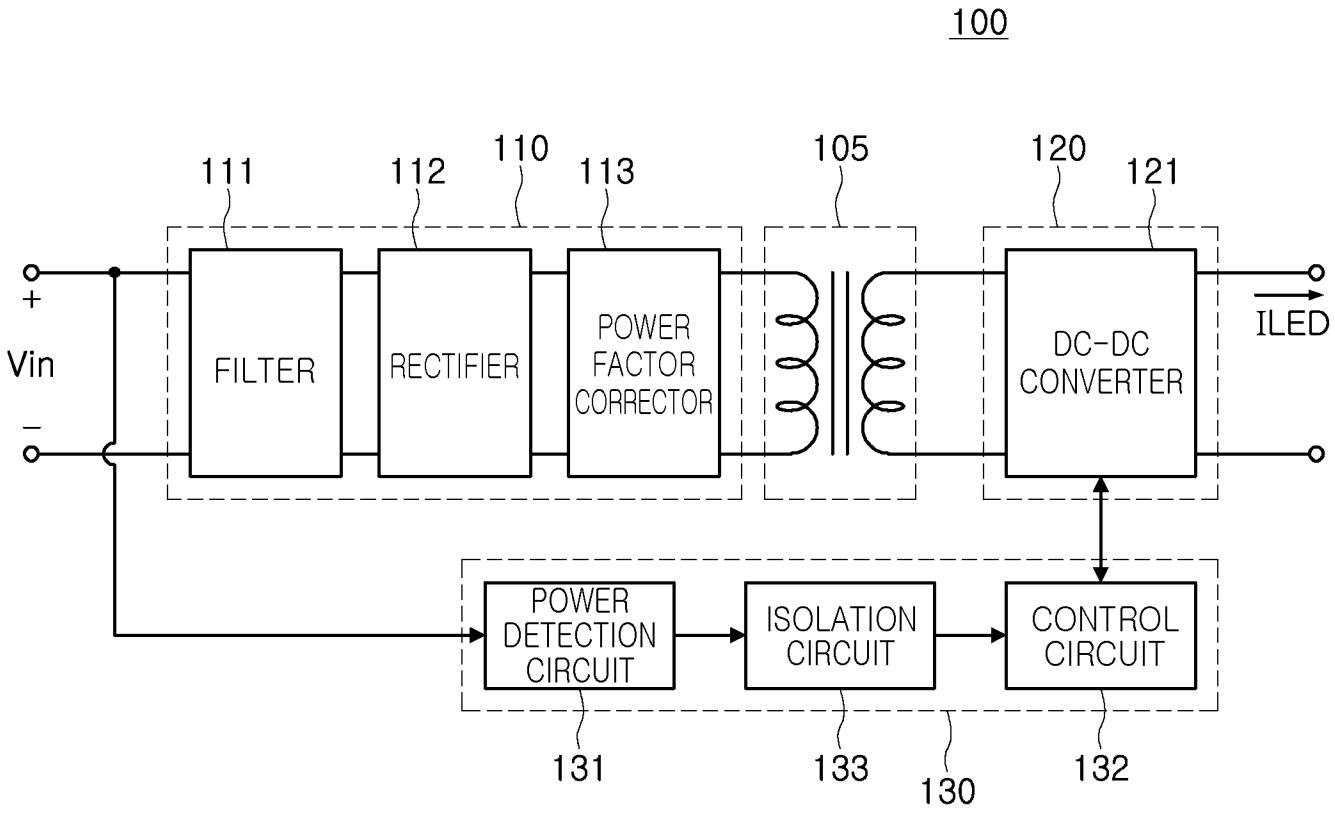
FIGS. 2 and 3 are block diagrams illustrating an LED driving apparatus, according to example embodiments.
Figure 3:
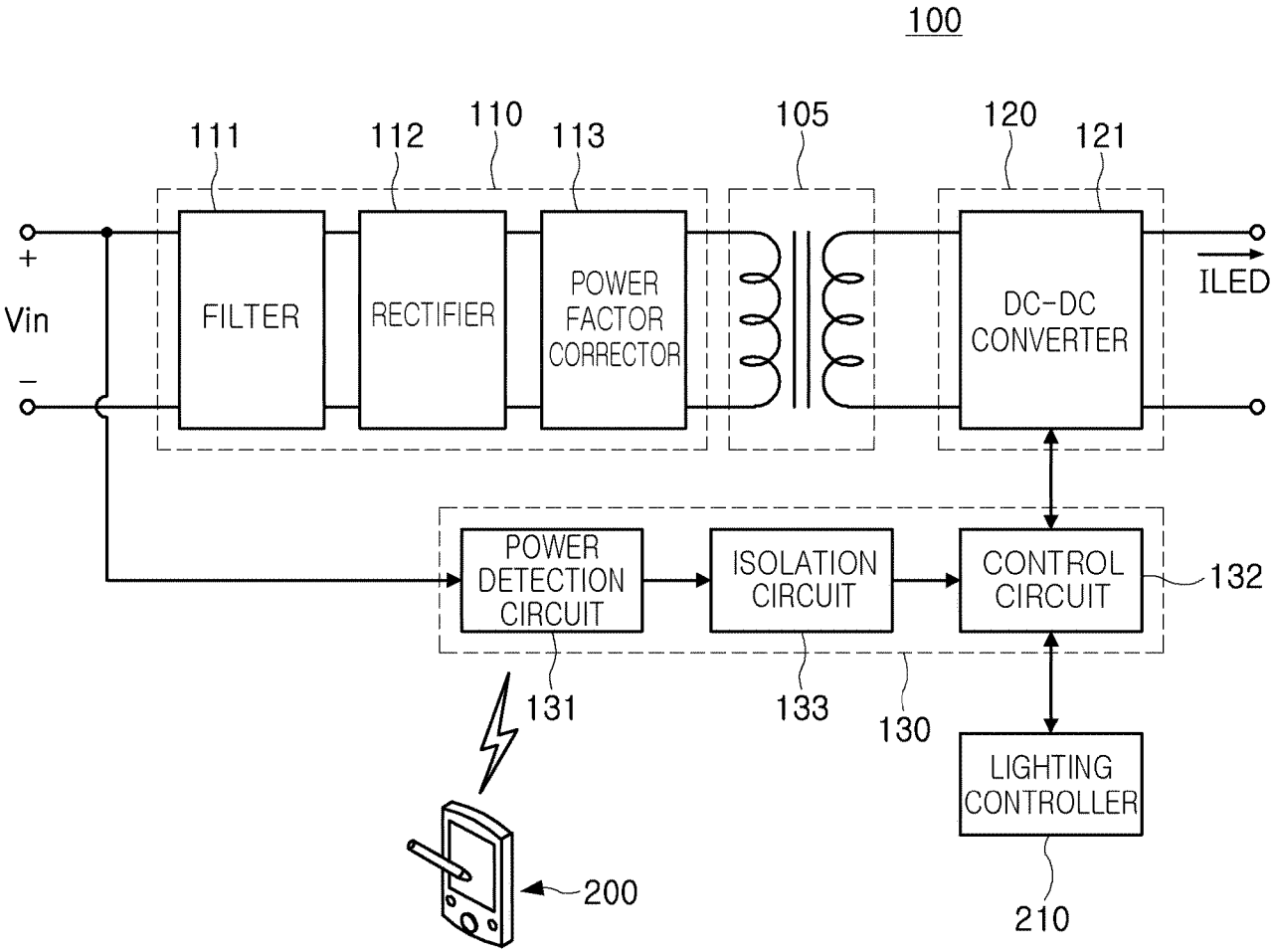

FIGS. 2 and 3 are block diagrams illustrating an LED driving apparatus, according to example embodiments.

With reference to FIG. 2, an LED driving apparatus 100 includes a first circuit 110 and a second circuit 120, and the first circuit 110 and the second circuit 120 may be isolated from each other by a transformer 105. The first circuit 110 may include a filter 111, a rectifier 112, and a power factor corrector 113. The filter 111 may be provided as a circuit which removes a noise component contained in AC power transferred by a power supply. For example, as the filter 111, an electromagnetic interference (EMI) filtering circuit or the like may be employed. The rectifier 112 may be provided as a circuit which full-wave or half-wave rectifies AC power filtered at the filter 111, and may be implemented by a diode bridge or the like. The power factor corrector 113 may include a circuit such as a power factor correcting (PFC) converter, or the like.

An output terminal of the power factor corrector 113 is connected to a primary winding of the transformer 105, and the transformer 105 may transfer energy in the primary winding to a secondary winding. The secondary winding of the transformer 105 is connected to the second circuit 120, and the second circuit 120 may include a DC-DC converter 121. In an example embodiment, a constant voltage converter may be further connected between the secondary winding of the transformer 105 and the DC-DC converter 116.

A controller 130 may include a power detection circuit 131, a control circuit 132, an isolation circuit 133, and the like. The power detection circuit 131 may detect input power supplied to the first circuit 110 connected to the primary winding of the transformer 105. In an example embodiment, the power detection circuit 131 may detect input power by measuring a magnitude of an input voltage Vin from an input terminal of the first circuit 110, for example, an input terminal of the filter 111.

The control circuit 132 may be implemented by a microcontroller, or the like, and may control output power supplied to at least one LED by the DC-DC converter 121, for example, current $I_{LED}$ driving an LED. The DC-DC converter 121 may include a circuit, such as a buck converter, a boost converter, or the like, and the control circuit 132 may control output power by changing a switching frequency, a duty ratio, or the like of a switching device included in the DC-DC converter 121.

In other words, the power detection circuit 131 may detect input power of the first circuit 110 connected to the primary winding of the transformer 105, and the control circuit 132 may control operations of the second circuit 120 connected to the secondary winding of the transformer 105. Thus, the isolation circuit 133 may be provided for connection between the power detection circuit 131 and the control circuit 132. The isolation circuit 133 may be a circuit for communications between the power detection circuit 131 and the control circuit 132 which are insulated from each other, and may include a photo-coupler circuit, or the like.

The power detection circuit 131 may include a power metering controller capable of generating a predetermined control command based on a magnitude of the input power. The power detection circuit 131 compares the magnitude of the input power with a predetermined reference power magnitude range, and then may determine whether a failure has occurred in an LED connected to an output terminal of the second circuit 120, whether an abnormality has occurred in input power supplied to the first circuit 110, whether an abnormality has occurred in output power output by the second circuit 120, or the like, based on a comparison result. When an LED failure, an abnormality in input/output power, or the like is detected, the power detection circuit 131 may generate and transmit a control command for protection of the LED driving apparatus 100 to the control circuit 132. The control command may be transmitted thereto through the isolation circuit 133.

For example, when an open defect has occurred in at least one LED of a plurality of LEDs connected to the second circuit 120, a magnitude of input power may be reduced and then detected to be below a lower limit of the reference power magnitude range. When the magnitude of the input power is reduced to be below the lower limit of the reference power magnitude range, the power detection circuit 131 may determine that an open defect has occurred in at least a portion of the plurality of LEDs, or a failure has occurred in the power supply itself.

When a magnitude of input power is reduced, the power detection circuit 131 may generate and transmit a control command to the control circuit 132 to block output power supplied from the second circuit 120. In a case in which there is a difficulty in normally operating the second circuit 120 as a magnitude of input power is reduced, the LED driving apparatus 100 is continuously operated, and thereby, damage may occur in a circuit element included in the LED driving apparatus 100. To prevent such damage, the power detection circuit 131 and the control circuit 132 control operations of the second circuit 120 to be stopped and output power to be blocked, to protect the LED driving apparatus 100 and the plurality of LEDs operated by the LED driving apparatus 100.

In a case in which a short circuit occurs in at least one LED of the plurality of LEDs connected to the second circuit 120, input power may be increased and thereby may exceed an upper limit of the reference power magnitude range. When the magnitude of the input power is greater than the upper limit of the reference power magnitude range, the power detection circuit 131 may determine that a failure has occurred in a power supply supplying the input power or a short circuit has occurred in a portion of the plurality of LEDs.

In this case, the power detection circuit 131 may generate and transmit a control command to the control circuit 132 to block output power supplied from the second circuit 120. In a case in which a short circuit occurs in a portion of the plurality of LEDs, a load connected to an output terminal of the second circuit 120 may be reduced. Thus, in a case in which the second circuit 120 supplies output power of a constant magnitude, an LED included in a light source may be damaged. To prevent the damages to an LED, the power detection circuit 131 may generate and transmit a control command to the control circuit 132 to stop operations of the second circuit 120.

In a case in which a magnitude of input power is outside the predetermined reference power magnitude range, the power detection circuit 131 may generate a control command for changing a magnitude of output power supplied by the second circuit 120. For example, when a magnitude of input power is above an upper limit of the reference power magnitude range or below a lower limit thereof, the power detection circuit 131 may provide a dimming function for changing brightness of light output by at least one of the plurality of LEDs. Thus, even in a case in which an increase or a decrease in a magnitude of input power which a user did not expect occurs, stable operations of the LED driving apparatus 100 may be secured.

With reference to FIG. 3, the power detection circuit 131 may be connected to an external electronic device 200 to communicate therewith via wireless communications. The external electronic device 200 may be a variety of devices such as a smartphone, a tablet PC, a desktop computer, a laptop computer, a smart TV, or the like, and one power detection circuit 131 may be connected to a plurality of external electronic devices 200 or vice versa. In an example embodiment, a power detection circuit 131 may send and receive data by various wireless communications protocols such as Bluetooth, WLAN, UWB, Zigbee®, Wi-Fi, or the like with the external electronic device 200. Although FIG. 3 illustrates that the power detection circuit 131 and the external electronic device 200 are connected via wireless communications, the power detection circuit 131 and the external electronic device 200 may also be connected via wired communication lines.

The LED driving apparatus 100 may be connected to a separately provided lighting controller 210 by the digital addressable lighting interface (DALI) communications protocol. The lighting controller 210 may control operations of the LED driving apparatus 100 by transmitting various control commands to the control circuit 132 based on the DALI communications protocol. The lighting controller 210 may be connected to a plurality of LED driving apparatuses 100, and a unique address based on the DALI communications protocol may be allocated to each of the plurality of LED driving apparatuses 100.

When the lighting controller 210 and the LED driving apparatus 100 are connected to each other by the DALI communications protocol, in order for the lighting controller 210 to control the LED driving apparatus 100 according to the DALI communications protocol, the LED driving apparatus 100 may detect a state of at least one of the plurality of LEDs and/or the LED driving apparatus 100 itself such a lamp failure, an input power abnormality, a load increase and decrease, or the like. According to an example embodiment, the LED driving apparatus 100 may determine the lamp failure, the input power abnormality, the load increase and decrease, or the like, based on the magnitude of the input power detected by the power detection circuit 131, and transmit information therebout based on the determination to the lighting controller 210.

In other words, according to the example embodiment, the power detection circuit 131 may be provided to detect an open defect, a short circuit, or the like in at least one LED of the plurality of LEDs and properly protect the LED driving apparatus 100 and/or the LEDs when the open defect or the short circuit has occurred. The power detection circuit 131 may be a power metering controller, and may generate a predetermined control command when the open defect, the short circuit, or the like is detected in the LED by detecting a magnitude of input power. The control command is transmitted to the control circuit 132 through the isolation circuit 133, and the control circuit 132 may efficiently protect the LED driving apparatus 100 and/or the LEDs by controlling operations of the second circuit 120 according to the control command. In other words, the LED driving apparatus 100 and/or the LEDs may only be protected from overload, an open defect, or a short circuit by the power detection circuit 131 without a separate circuit configuration being required.

In addition, as input power is detected by using the power detection circuit 131, a state detection function of detecting a state of the LED driving apparatus 100 and/or at least one of the LEDs such as a lamp failure, an input power abnormality, a load increase and decrease, or the like defined in the DALI communications protocol may be implemented. A state of the LED driving apparatus 100 and/or the LED detected by the power detection circuit 131 may be transmitted to the lighting controller 210 through the control circuit 132 according to the DALI communications protocol.

A power consumption monitoring function may be implemented through an external electronic device 200 by using a communications function of the power detection circuit 131. The power detection circuit 131 may calculate power consumption of the LED driving apparatus 100 based on a magnitude of input power, and transmit the power consumption to the external electronic device 200. In addition, an application executed in the external electronic device 200 may calculate power consumption of the LED driving apparatus 100 using input power detected by the power detection circuit 131.

Figure 4:
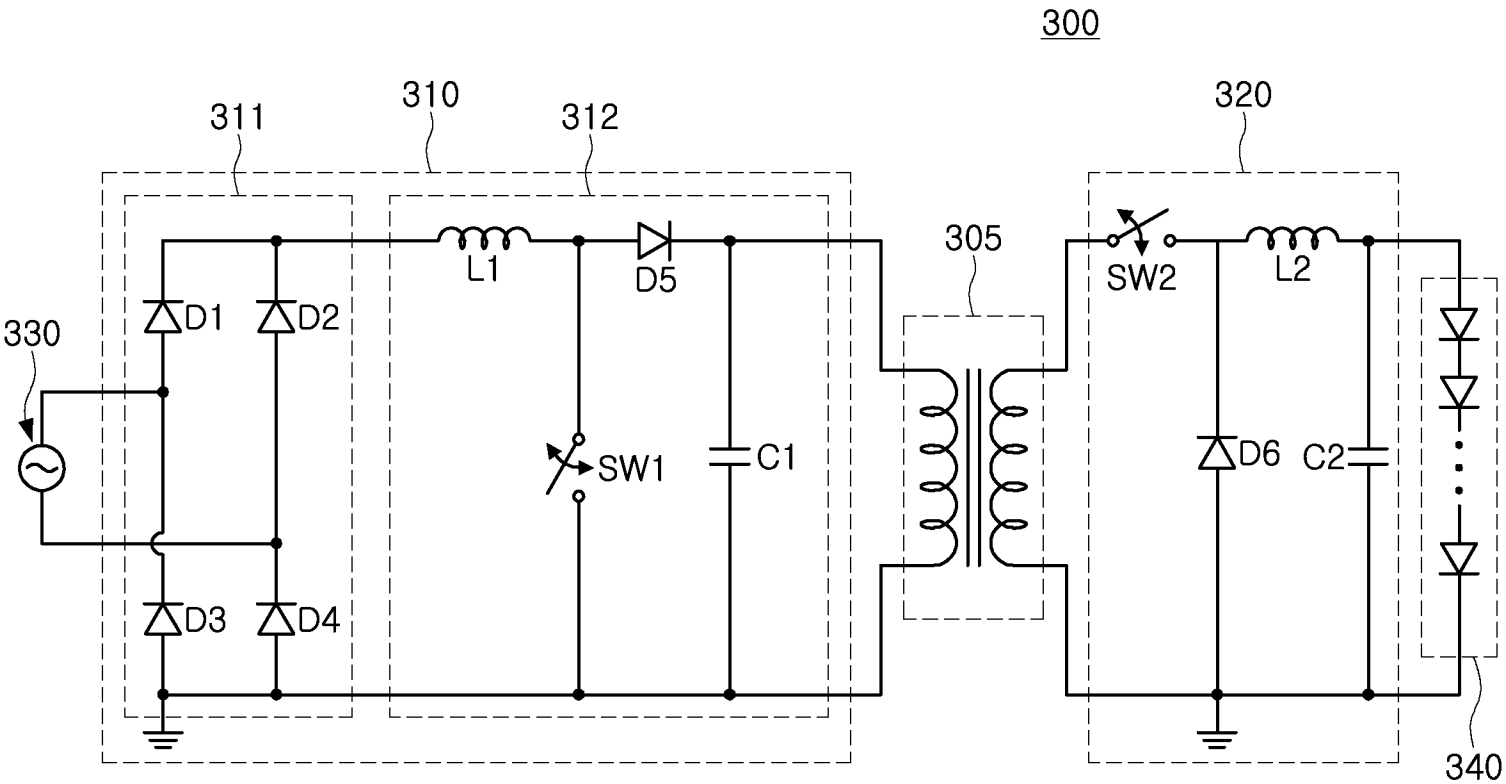
FIGS. 4 and 5 are circuit diagrams illustrating an LED driving apparatus, according to example embodiments.
Figure 5:
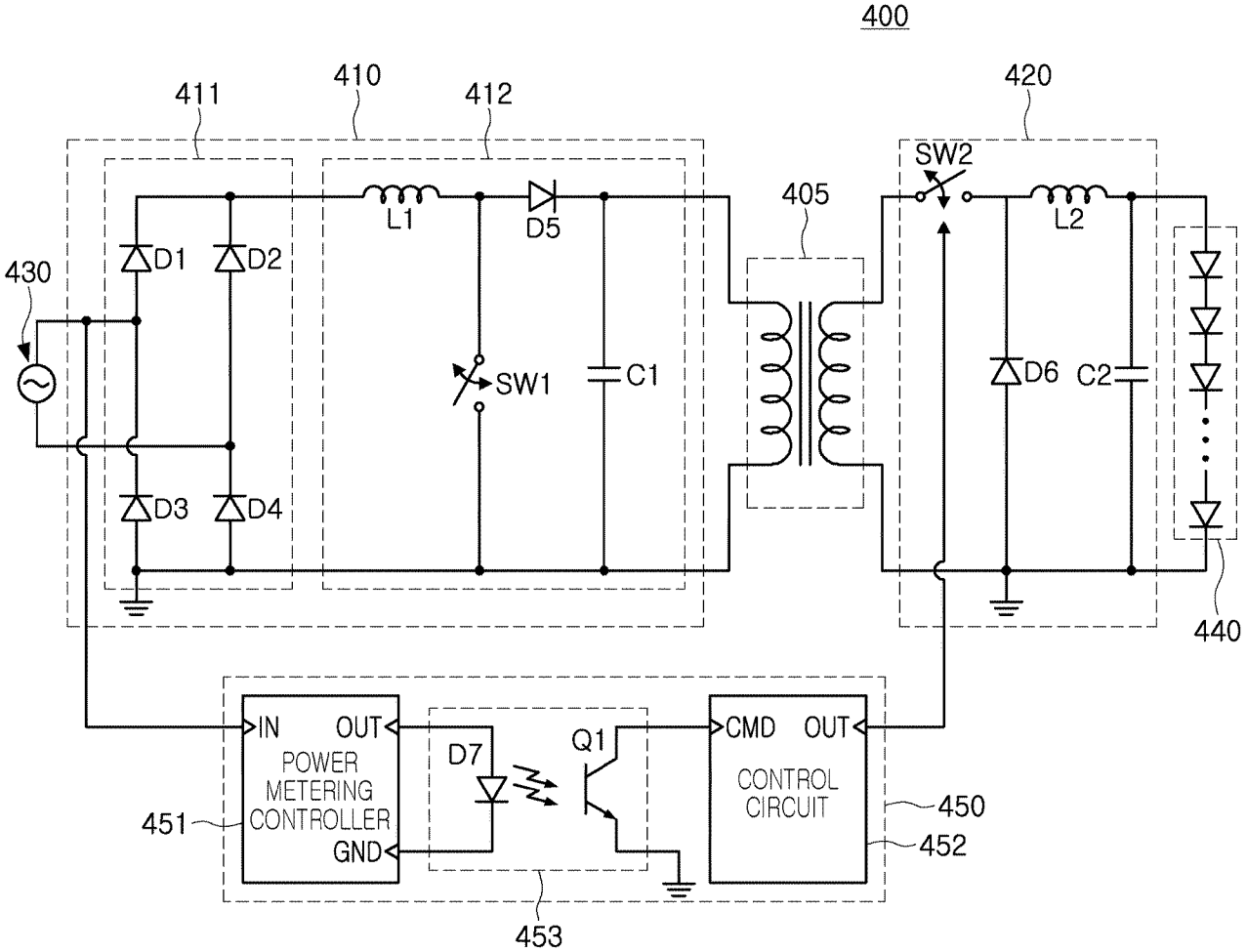

FIGS. 4 and 5 are circuit diagrams illustrating an LED driving apparatus, according to example embodiments.

First, with reference to FIG. 4, an LED driving apparatus 300 according to an example embodiment may include a first circuit 310 connected to a primary winding of a transformer 305, and a second circuit 320 connected to a secondary winding of the transformer 305. The first circuit 310 may include a rectifier 311 rectifying input power supplied from a power supply 330, a power factor corrector 312, and the like. A filter removing a noise component of input power supplied from the power supply 330 may also be connected between the rectifier 311 and the power supply 330.

The second circuit 320 is connected to the secondary winding of the transformer 305, and may include a DC-DC converter. FIG. 4 illustrates that the second circuit 320 includes a buck converter circuit. However, the second circuit 320 may include a boost converter circuit, a buck-boost converter circuit, and the like.

With reference to the first circuit 310, the rectifier 311 may be implemented by a diode bridge circuit containing four diodes D1-D4. The power factor corrector 312 may be implemented as a boost converter circuit having an inductor L1, a diode D5, a capacitor C1, and a switching device SW1. As the power factor corrector 312 is implemented by the boost converter circuit, crossover distortion may be significantly reduced and current may be continuously output. In a manner different from the example embodiment illustrated in FIG. 4, the power factor corrector 312 may also be implemented by another converter circuit such as a buck converter circuit or a buck-boost converter circuit.

The second circuit 320 may include a buck converter circuit including a switching device SW2, a diode D6, an inductor L2, and a capacitor C2. A magnitude of output power supplied to a plurality of LEDs 340 by the second circuit 320 may be changed according to an operating frequency or a duty ratio of the switching device SW2 included in the second circuit 320. Thus, when the LED driving apparatus 300 is connected to a lighting controller, such as the lighting controller 210 of FIG. 3, through the DALI communications protocol, the lighting controller may control brightness of the LEDs 340 by changing an operating frequency or a duty ratio of the switching device SW2.

Next, with reference to FIG. 5, an LED driving apparatus 400 may further include a controller 450 in addition to a first circuit 410 and a second circuit 420 which are isolated by a transformer 405. The controller 450 may include a power detection circuit 451 detecting a magnitude of input power supplied to the first circuit 410 from a power supply 430, and a control circuit 452 controlling output power generated by the second circuit 420. The power detection circuit 451 may be connected to a primary side of the transformer 405, and the control circuit 452 may be connected to a secondary side of the transformer 405, and thereby the power detection circuit 451 and the control circuit 452 may be insulated from each other.

Thus, the controller 450 may include an isolation circuit 453 for connection between the power detection circuit 451 and the control circuit 452 isolated from each other. The isolation circuit 453 may include a photo-coupler circuit. The photo-coupler circuit may contain a diode D7 and a transistor Q1, and the diode D7 and the transistor Q1 may be connected to the power detection circuit 451 and the control circuit 452, respectively. The diode D7 may emit light according to data to be transmitted by the power detection circuit 451, and the transistor Q1 may detect and transfer the data to the control circuit 452.

The power detection circuit 451 may include a power metering controller. The power detection circuit 451 may detect input power output by the power supply 430, and determine whether an abnormality has occurred in the LED driving apparatus 400 based on a magnitude of the input power. In an example embodiment, when a magnitude of input power is within a predetermined reference power magnitude range, the power detection circuit 451 may determine that the LED driving apparatus 400 is operating normally. The power detection circuit 451 may determine that a short circuit has occurred in at least one LED of a plurality of LEDs included in a light source 440 when a magnitude of input power exceeds an upper limit of the reference power magnitude range. The power detection circuit 451 may determine that a connection failure or an open defect has occurred in at least one LED of the LEDs included in the light source 440 when a magnitude of input power is below a lower limit of the reference power magnitude range.

When it is determined that an abnormality has occurred in the LED driving apparatus 400, the power detection circuit 451 may generate a predetermined control command and transmit the predetermined control command to the control circuit 452. The control command may be a command for stopping light emitting operations of the light source 440, or for increasing or decreasing brightness of the light source 440 by controlling operations of a switching device SW2 included in the second circuit 420. The control command may be transmitted to the control circuit 452 through the isolation circuit 453.

In an example embodiment, when a magnitude of input power is below a lower limit of the reference power magnitude range, the power detection circuit 451 may determine that a connection failure has occurred in a portion of the LEDs, or an open defect has occurred as a portion of the LEDs is damaged. In this case, the power detection circuit 451 may determine whether the LED driving apparatus 400 will be continuously operated, according to a magnitude of input power, and may transmit a proper control command to the control circuit 452 accordingly. When a magnitude of input power is significantly reduced, and thus, it is determined that there is a difficulty in normally operating the LED driving apparatus 400, the power detection circuit 451 may stop light emitting operations of the light source 440 by turning-off the switching device SW2. On the other hand, when a decline in a magnitude of input power is not great, and thus, it is determined that normal operations of the LED driving apparatus 400 are possible, the power detection circuit 451 may control brightness of the light source 440 by varying an operating frequency or a duty ratio of the switching device SW2.

A reference power magnitude range compared with a magnitude of input power by the power detection circuit 451 may be a value set when the LED driving apparatus 400 is initially driven, or a value set by a user. As described above, the controller 450 may be connected to an external electronic device, such as the external electronic device 200 of FIG. 3, to communicate therewith by wired/wireless communications, and a user may set the reference power magnitude range to determine whether the LED driving apparatus 400 is normally operated by using the external electronic device.

In addition, the user may monitor power consumption of the LED driving apparatus 400 through the external electronic device. Power consumption of the LED driving apparatus 400 may be calculated by input power detected by the power detection circuit 451, and the user may monitor power consumption of the LED driving apparatus 400 in real time through the external electronic device connected to the controller 450 to communicate therewith.

Figure 6:
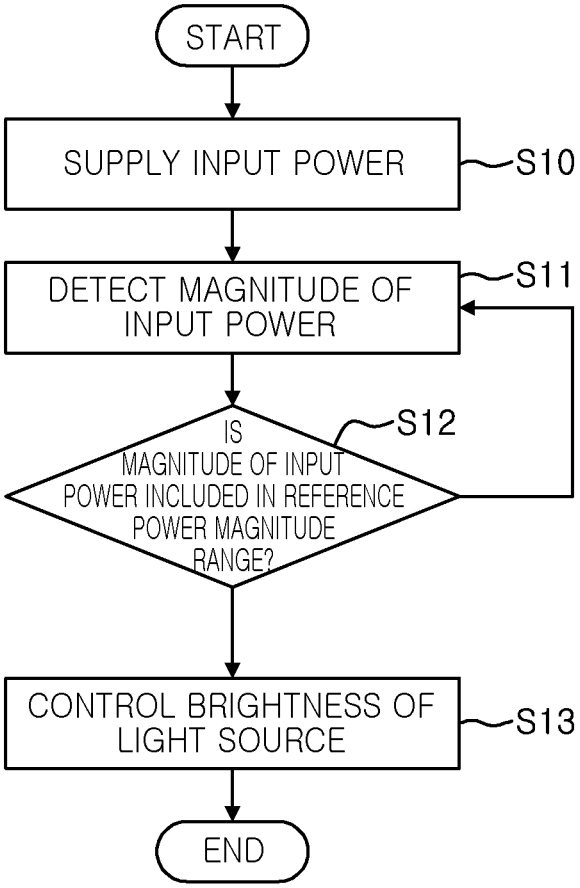
FIGS. 6 and 7 are flow diagrams illustrating operations of an LED driving apparatus, according to example embodiments.
Figure 7:
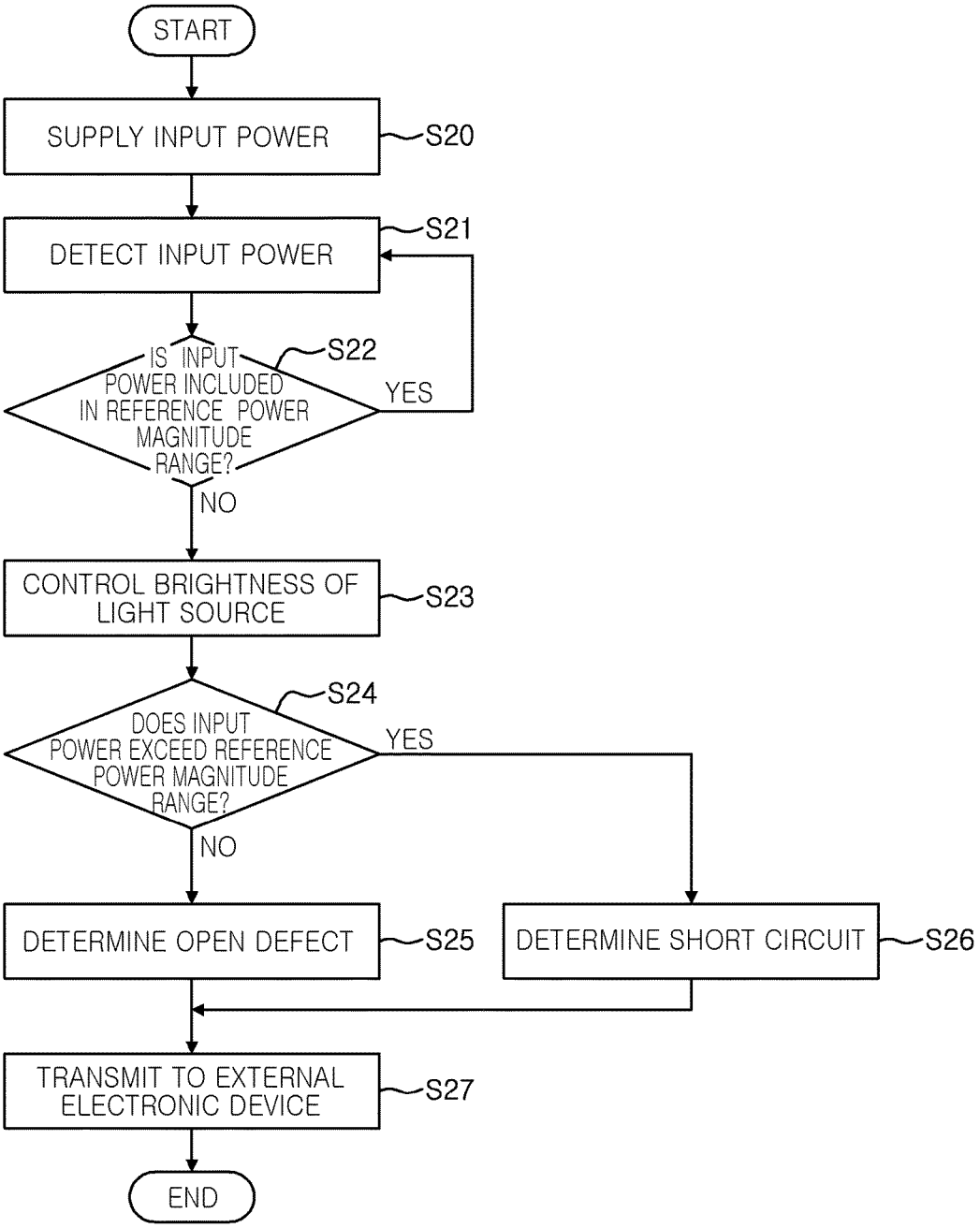

FIGS. 6 and 7 are flow diagrams provided for illustrating operations of an LED driving apparatus, according to example embodiments. Hereinafter, the operations of an LED driving apparatus is described with reference to FIG. 3 for convenience of explanation.

First, with reference to FIGS. 3 and 6, input power may be supplied to the first circuit 110 (S10). The first circuit 110 is connected to the primary winding of the transformer 105, and may be isolated from the second circuit 120 connected to the secondary winding of the transformer 105. When input power is supplied to the first circuit 110, the power detection circuit 131 may detect a magnitude of input power by measuring voltage Vin from the input terminal of the first circuit 110 (S11). For this, the power detection circuit 131 may include a power metering controller.

The power detection circuit 131 may determine whether a magnitude of input power is within a predetermined reference power magnitude range (S12). The reference power magnitude range may be defined as a voltage range of input power received by the first circuit 110 when the LED driving apparatus 100 is operated normally. As a result of operation S12, when input power is determined to be within the reference power magnitude range, the power detection circuit 131 may detect a magnitude of input power continuously, or for each set period without additional operations.

On the other hand, as a determination result of operation S12, when input power is determined not to be within the predetermined reference power magnitude range, the power detection circuit 131 may control brightness of a light source connected to the LED driving apparatus 100 (S13). To control brightness in operation S13, the power detection circuit 131 may generate a predetermined control command, and may transmit the control command to the control circuit 132 through the isolation circuit 133. The control circuit 132 may turn-off a plurality of LEDs included in the light source and connected to an output terminal of the second circuit 120, or may increase or decrease brightness based on the control command.

Next, with reference to FIGS. 3 and 7, input power may be supplied to the first circuit 110 (S20), and the power detection circuit 131 may detect the input power (S21). The power detection circuit 131 may determine whether input power is within a preset reference power magnitude range (S22). As a determination result of operation S22, when a magnitude of input power is within a reference power magnitude range, the power detection circuit 131 may determine that the LED driving apparatus 100 is operated normally. On the other hand, as a determination result of operation S22, when it is determined that input power is not within the predetermined reference power magnitude range, the power detection circuit 131 may determine that an abnormality has occurred in the LED driving apparatus 100 or at least a portion of a plurality of LEDs operated by the LED driving apparatus 100.

As a determination result of operation S22, when a magnitude of input power is above an upper limit of the reference power magnitude range or below a lower limit thereof, the power detection circuit 131 may generate a control command for controlling brightness of a plurality of LEDs and transmit the control command to the control circuit 132. The control circuit 132 may receive the control command through the isolation circuit 133, and may control operations of the second circuit 120 according to the control command, thereby increasing or decreasing brightness of at least one of the LEDs or turning-off at least one of the LEDs (S23).

In addition, in the example embodiment illustrated in FIG. 7, a controller 130 may control brightness of at least one of the LEDs, and may also determine how a magnitude of input power exceeds a reference power magnitude range (S24). As a determination result of operation S24, when the input power is determined to be below a lower limit of the reference power magnitude range, the power detection circuit 131 may determine that a connection failure or an open defect has occurred in a portion of the LEDs connected to an output terminal of the second circuit 120 (S25). When determined that a magnitude of input power is above an upper limit of the reference power magnitude range as a determination result of operation S24, the power detection circuit 131 may determine that a short circuit has occurred in a portion of the LEDs connected to the output terminal of the second circuit 120 (S26).

When a type of failure occurring in the LED driving apparatus 100 or the LEDs is determined by comparing a magnitude of input power with the reference power magnitude range, a controller 130 may provide an external electronic device 200 with the occurrence of a failure. As in the example embodiment illustrated in FIG. 3, the controller 130 may be connected to the external electronic device 200 to communicate therewith. The controller 130 compares a magnitude of input power with the reference power magnitude range, and then predicts a type of failure occurring in at least one of the LEDs, the LED driving apparatus 100, or the like (S24-S26). Thus, the controller 130 transmits information about the type of failure to the external electronic device 200, thereby quickly notifying a user as to a failure of at least one of the LEDs and/or the LED driving apparatus 100 has occurred.

The controller 130 may also provide notification of power consumption of the LED driving apparatus 100 in addition to the failure of at least one of the LEDs, the LED driving apparatus 100 or the like has occurred, to the external electronic device 200. As previously described with reference to FIG. 3, the controller 130 may be connected to the external electronic device 200 via wired/wireless communications. The power detection circuit 131 detects a magnitude of input power and then calculates power consumption of the LED driving apparatus 100. Thus, the power detection circuit 131 transmits information about the power consumption to the external electronic device 200, thereby providing a power consumption monitoring function for a user.

Figure 8A:
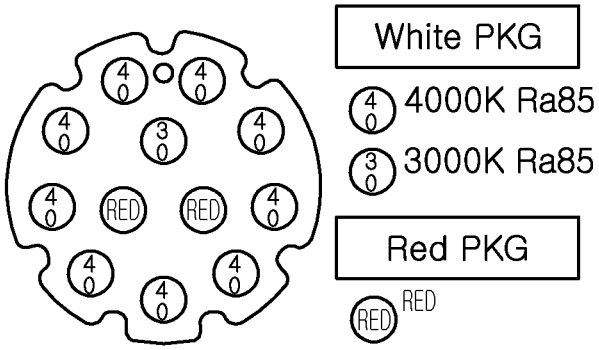
FIGS. 8A and 8B are drawings schematically illustrating a white light source module to be applied to a lighting apparatus, according to example embodiments.
Figure 8B:
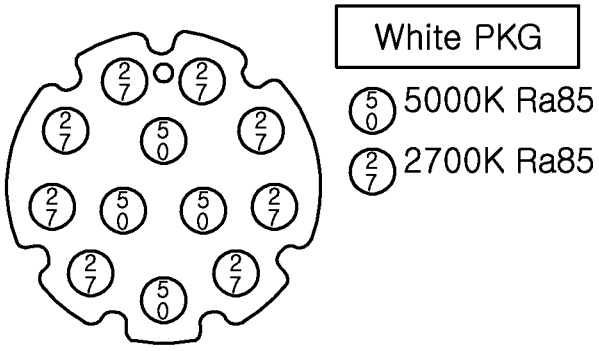
Figure 9:
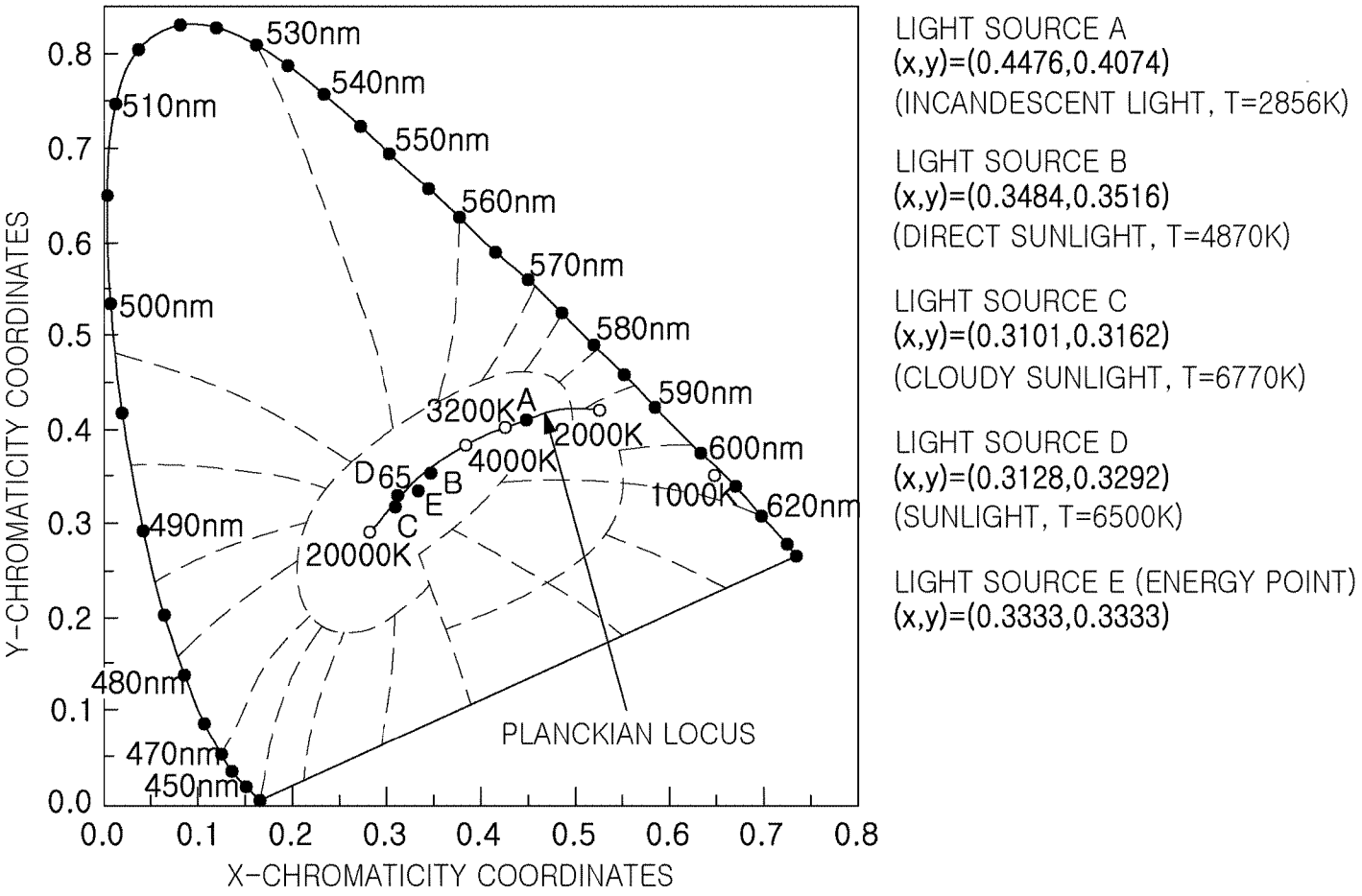
FIG. 9 is a CIE 1931 color space diagram illustrating operations of a white light source module illustrated in FIGS. 8A and 8B, according to an example embodiment.

FIGS. 8A and 8B are drawings schematically illustrating a white light source module applied to a lighting apparatus, according to example embodiments. FIG. 9 is a Comission Internationale de l'Eclairage (CIE) 1931 color space diagram illustrating operation of the white light source module illustrated in FIGS. 8A and 8B.

The white light source module illustrated in FIGS. 8A and 8B may include a plurality of light emitting device packages mounted on respective circuit boards. Although a plurality of light emitting device packages mounted on one white light source module may be configured of the same type of packages generating light having the same wavelength, as in the example embodiment, the plurality of light emitting device packages may also be configured of different types of packages generating light having different wavelengths.

With reference to FIG. 8A, a white light source module may be configured by combining white light emitting device packages '40' and '30' having color temperatures of 4000K and 3000K with red light emitting device packages (RED). In the white light source module, a color temperature may be controlled to be within a range of 3100K to 4000K, and white light having a color rendering index Ra in a range of 85 to 100 may be provided.

In another example embodiment, a white light source module may only be configured of white light emitting device packages, but some packages may have white light having a different color temperature. For example, as illustrated in FIG. 8B, as a white light emitting device package '27' having a color temperature of 2700K and a white light emitting device package '50' having a color temperature of 5000K are combined, white light having a color temperature to be controlled within a range of 2200K to 5000K and having a color rendering index Ra of 85 to 99 may be provided. Here, the number of light emitting device packages having respective color temperatures may be changed according to a default color temperature setting value. For example, in a case in which a default setting value of a lighting apparatus has around 4000K in a color temperature, the number of packages corresponding to 4000K may be greater than the number of packages corresponding to 3100K in a color temperature or the number of red light emitting device packages.

As described above, the different types of light emitting device packages are configured to include a light emitting device emitting white light by combining yellow, green, red, or orange phosphor with a blue light emitting device and at least one of violet, blue, green, red, or infrared light emitting devices, thereby controlling a color temperature and a color rendering index (CRI) of the white light. The above-described white light source module may be employed as a light source in various forms of lighting apparatus.

In a single light emitting device package, according to a wavelength of an LED chip which is a light emitting device, a type of phosphor, and a mixing ratio thereof, light with a required color is determined. In addition, in a case of white light, a color temperature and a color rendering index may be controlled.

For example, when an LED chip emits blue light, a light emitting device package including at least one among yellow, green, and red phosphors may emit white light having different color temperatures according to a mixing ratio of the phosphor. Whereas a light emitting device package in which a green or red phosphor is applied to a blue LED chip may emit green or red light. As described above, the light emitting device package emitting white light and the package emitting green or red light are combined, and thereby a color temperature and a color rendering index of the white light may be controlled. In addition, the light emitting device package may be configured to include at least one among light emitting devices emitting violet, blue, green, red, or infrared light.

In this case, the lighting apparatus may control a color rendering index from a level of light output by a sodium halide lamp to a level of sunlight, and may generate various types of white light having a color temperature of 1500K to 20000K. In addition, as required, violet, blue, green, red, and orange visible light or infrared light may be generated, whereby a lighting color may be controlled, especially for an ambient atmosphere or a mood. In addition, light having a special wavelength capable of promoting plant growth may be generated.

White light obtained by combining a blue light emitting device with yellow, green, red phosphors and/or a green, red light emitting device may have two or more peak wavelengths, and as illustrated in FIG. 9, coordinates (x, y) thereof on a CIE 1931 color space diagram may be located on line segments (0.4476, 0.4074), (0.3484, 0.3516), (0.3101, 0.3162), (0.3128, 0.3292), and (0.3333, 0.3333) connected to one another. Alternatively, the coordinates (x, y) may be located in a region surrounded by line segments and a black body radiation spectrum. A color temperature of the white light may be within a range of 2000K to 20000K. In FIG. 9, white light near the point E (0.3333, 0.3333) in the vicinity of a point E (0.3333, 0.3333) below the blackbody radiation spectrum may be in a state in which light of a yellow-based component becomes relatively weak. Thus, a lighting device product using white light in the vicinity of the point E (0.3333, 0.3333) below the blackbody radiation spectrum may be effective for use in retail spaces in which groceries, clothing, or the like are for sale.

Figure 10:
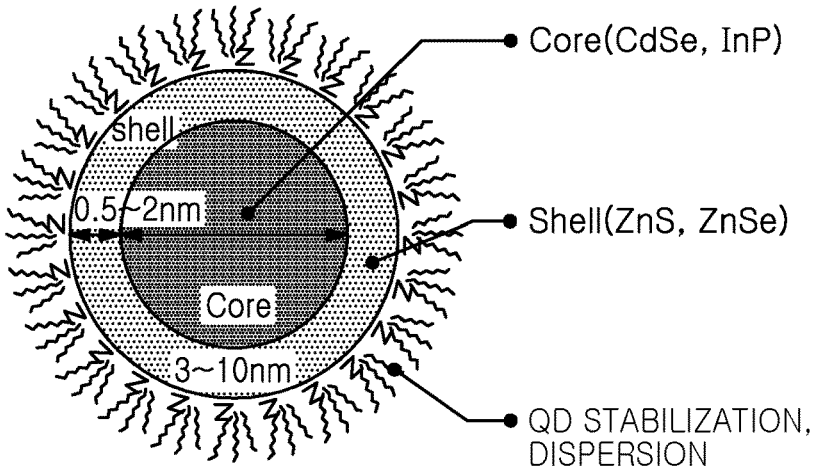
FIG. 10 is a drawing illustrating a wavelength conversion material applied to a light source of a lighting apparatus, according to an example embodiment.

FIG. 10 is a drawing illustrating a wavelength conversion material that may be applied to a light source of a lighting apparatus, according to an example embodiment.

A wavelength conversion material is provided as a material converting a wavelength of light emitted from a light emitting device, and various materials such as a phosphor and/or a quantum dot may be used.

In an example embodiment, phosphors applied to the wavelength conversion material may be represented by the following empirical formulae and have colors as below.

Oxide-based Phosphors: Yellow and green $Y_3Al_5O_{12}$:cerium (Ce), $Tb_3Al_5O_{12}$:Ce, $Lu_3Al_5O_{12}$:Ce Silicate-based Phosphors: Yellow and green $(Ba,Sr)_2SiO_4$:europium (Eu), yellow and yellowish-orange $(Ba,Sr)_3SiO_5$:Ce Nitride-based Phosphors: Green β-SiAlON:Eu, yellow $La_3Si_6N_{11}$:Ce, yellowish-orange α-SiAlON:Eu, red $CaAlSiN_3$:Eu, $Sr_2Si_5N_8$:Eu, $SrSiAl_4N_7$:Eu, $SrLiAl_3N_4$:Eu, $Ln_{4-x}(Eu_zM_{1-z})_xSi_{12-y}Al_yO_{3+x+y}N_{18-x-y}$ ($0.5 \le x \le 3$, $0<z<0.3$, $0<y \le 4$) (here, Ln is at least one selected from a group consisting of a group IIIa element and a rare-earth element, and M is at least one selected from a group consisting of calcium (Ca), barium (Ba), strontium (Sr), and magnesium (Mg))

Fluoride-based Phosphors: KSF-based red $K_2SiF_6:Mn^{4+}$, $K_2TiF_6:Mn^{4+}$, $NaYF_4:Mn^{4+}$, $NaGdF_4:Mn^{4+}$, $K_3SiF_7:Mn^{4+}$ A composition of phosphors should basically coincide with stoichiometry, and respective elements may be substituted with other elements in respective groups of the periodic table of elements. For example, Sr may be substituted with Ba, Ca, Mg, or the like, of an alkaline earth group II, and Y may be substituted with lanthanum-based terbium (Tb), lutetium (Lu), scandium (Sc), gadolinium (Gd), or the like. In addition, Eu or the like, an activator, may be substituted with Ce, Tb, praseodymium (Pr), erbium (Er), ytterbium (Yb), or the like, according to a required level of energy, and an activator alone or a sub-activator or the like, for modification of characteristics thereof, may additionally be used.

In further detail, in the case of a fluoride-based red phosphor, in order to improve reliability thereof at high temperature and high humidity, phosphors may be coated with fluoride not containing Mn or a phosphor surface or a fluoride-coated surface of phosphors, coated with a fluoride not containing Mn, may further be coated with an organic material. In the case of the fluoride-based red phosphor as described above, a narrow full width at half maximum of 40 nm or less may be obtained, unlike in the case of other phosphors, and thus, the fluoride-based red phosphors may be used in high-resolution TV sets such as UHD TVs.

The below table 1 indicates types of phosphor to be applied to respective applications with respect to a light emitting device package using a blue LED chip in which a main wavelength is 440 nm to 460 nm, or a UV LED chip in which a main wavelength is 380 nm to 440 nm.

TABLE 1

| Purpose | Phosphor |
|---|---|
| LED TV BLU | β-SiAlON:Eu2+<br>(Ca, Sr)AlSiN$_3$:Eu2+<br>La$_3$Si$_6$N$_{11}$:Ce3+<br>K$_2$SiF$_6$:Mn4+<br>SrLiAl3N4:Eu<br>Ln$_{4-x}$(Eu$_z$M$_{1-z}$)$_x$Si$_{12-y}$Al$_y$O$_{3+x+y}$N$_{18-x-y}$<br>(0.5 ≤ x ≤ 3, 0 < z < 0.3, 0 < y ≤ 4)<br>K2TiF6:Mn4+<br>NaYF4:Mn4+<br>NaGdF4:Mn4+ |
| Lighting | Lu$_3$Al$_5$O$_{12}$:Ce3+<br>Ca-α-SiAlON:Eu2+<br>La$_3$Si$_6$N$_{11}$:Ce3+<br>(Ca, Sr)AlSiN$_3$:Eu2+<br>Y$_3$Al$_5$O$_{12}$:Ce3+<br>K$_2$SiF$_6$:Mn4+<br>SrLiAl3N4:Eu<br>Ln$_{4-x}$(Eu$_z$M$_{1-z}$)$_x$Si$_{12-y}$Al$_y$O$_{3+x+y}$N$_{18-x-y}$<br>(0.5 ≤ x ≤ 3, 0 < z < 0.3, 0 < y ≤ 4)<br>K2TiF6:Mn4+<br>NaYF4:Mn4+<br>NaGdF4:Mn4+ |
| Side View<br>(Mobile, Note PC) | Lu$_3$Al$_5$O$_{12}$:Ce3+<br>Ca-α-SiAlON:Eu2+<br>La$_3$Si$_6$N$_{11}$:Ce3+<br>(Ca, Sr)AlSiN$_3$:Eu2+<br>Y$_3$Al$_5$O$_{12}$:Ce3+<br>(Sr, Ba, Ca, Mg)2SiO4:Eu2+<br>K$_2$SiF$_6$:Mn4+<br>SrLiAl3N4:Eu<br>Ln$_{4-x}$(Eu$_z$M$_{1-z}$)$_x$Si$_{12-y}$Al$_y$O$_{3+x+y}$N$_{18-x-y}$<br>(0.5 ≤ x ≤ 3, 0 < z < 0.3, 0 < y ≤ 4)<br>K2TiF6:Mn4+<br>NaYF4:Mn4+<br>NaGdF4:Mn4+ |
| Electric device<br>(Head lamp, etc.) | Lu$_3$Al$_5$O$_{12}$:Ce3+<br>Ca-α-SiAlON:Eu2+<br>La$_3$Si$_6$N$_{11}$:Ce3+<br>(Ca, Sr)AlSiN$_3$:Eu2+<br>Y$_3$Al$_5$O$_{12}$:Ce3+<br>K$_2$SiF$_6$:Mn4+<br>SrLiAl3N4:Eu<br>Ln$_{4-x}$(Eu$_z$M$_{1-z}$)$_x$Si$_{12-y}$Al$_y$O$_{3+x+y}$N$_{18-x-y}$<br>(0.5 ≤ x ≤ 3, 0 < z < 0.3, 0 < y ≤ 4)<br>K2TiF6:Mn4+<br>NaYF4:Mn4+<br>NaGdF4:Mn4+ |

On the other hand, the wavelength conversion material may include a quantum dot (QD) provided to replace a phosphor or be mixed with a phosphor.

FIG. 10 is a drawing illustrating a sectional structure of a quantum dot. The quantum dot may have a core-shell structure using a III-V or II-VI compound semiconductor. For example, the quantum dot (QD) may have a core formed using cadmium selenide (CdSe), indium phosphide (InP), or the like, and a shell formed using zinc sulfide (ZnS), zinc selenide (ZnSe), or the like. Further, the QD may have a ligand for stabilization of the core and the shell. For example, the core may have a diameter of approximately 1 nm to 30 nm, in detail, approximately 3 nm to 10 nm. The shell may have a thickness of approximately 0.1 nm to 20 nm, in detail, 0.5 nm to 2 nm.

The quantum dot may implement various colors of light depending on the size thereof. In detail, in a case in which the quantum dot is used as a phosphor substitute, the quantum dot may be used as a red or green phosphor. In the case of using the quantum dot, a narrow full width at half maximum of, for example, about 35 nm, may be obtained.

The wavelength conversion material may be implemented as being contained in the encapsulation portion, or first manufactured in a form of a film, and then attached to a surface of an optical apparatus such as an LED chip or a light guide plate. When the wavelength conversion material, which is first manufactured in a form of a film, is used, the application of the wavelength conversion material having a uniform thickness may be facilitated.

Figure 11:
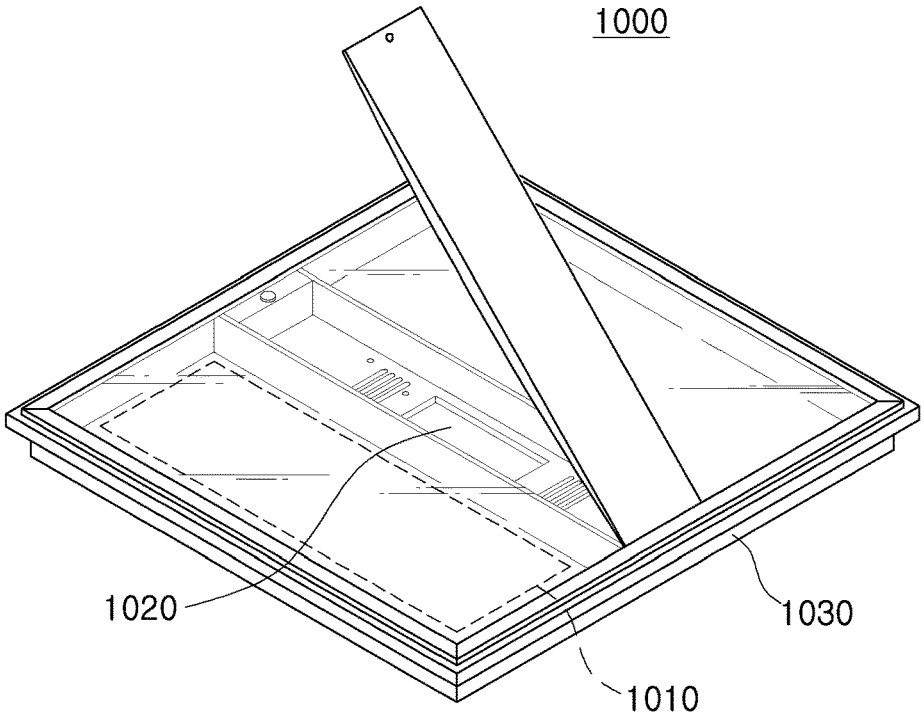
FIG. 11 is a perspective view schematically illustrating a flat lighting apparatus to which an LED driving apparatus, according to an example embodiment may be applied.

FIG. 11 is a perspective view schematically illustrating a flat lighting apparatus to which a semiconductor light emitting device, according to an example embodiment may be applied.

With reference to FIG. 11, a flat lighting apparatus 1000 may include a light source module 1010, a power supply device 1020, and a housing 1030. According to an example embodiment, the light source module 1010 may include a light emitting device array as a light source, and the power supply device 1020 may include a light emitting device driving circuit. As an example embodiment, a flat lighting apparatus according to an example embodiment illustrated in FIG. 11 may include an LED driving apparatus according to various example embodiments.

The light source module 1010 may include a light emitting device array, and may be formed to have a substantially planar form. On the other hand, the power supply device 1020 may be configured to supply power to the light source module 1010. The housing 1030 may include an accommodating space in which the light source module 1010 and the power supply device 1020 are accommodated. In addition, the housing may be formed in the form of a hexahedron of which one lateral side is opened, but is not limited thereto. The light source module 1010 may be disposed to emit light toward the one open side of the housing 1030.

Figure 12:
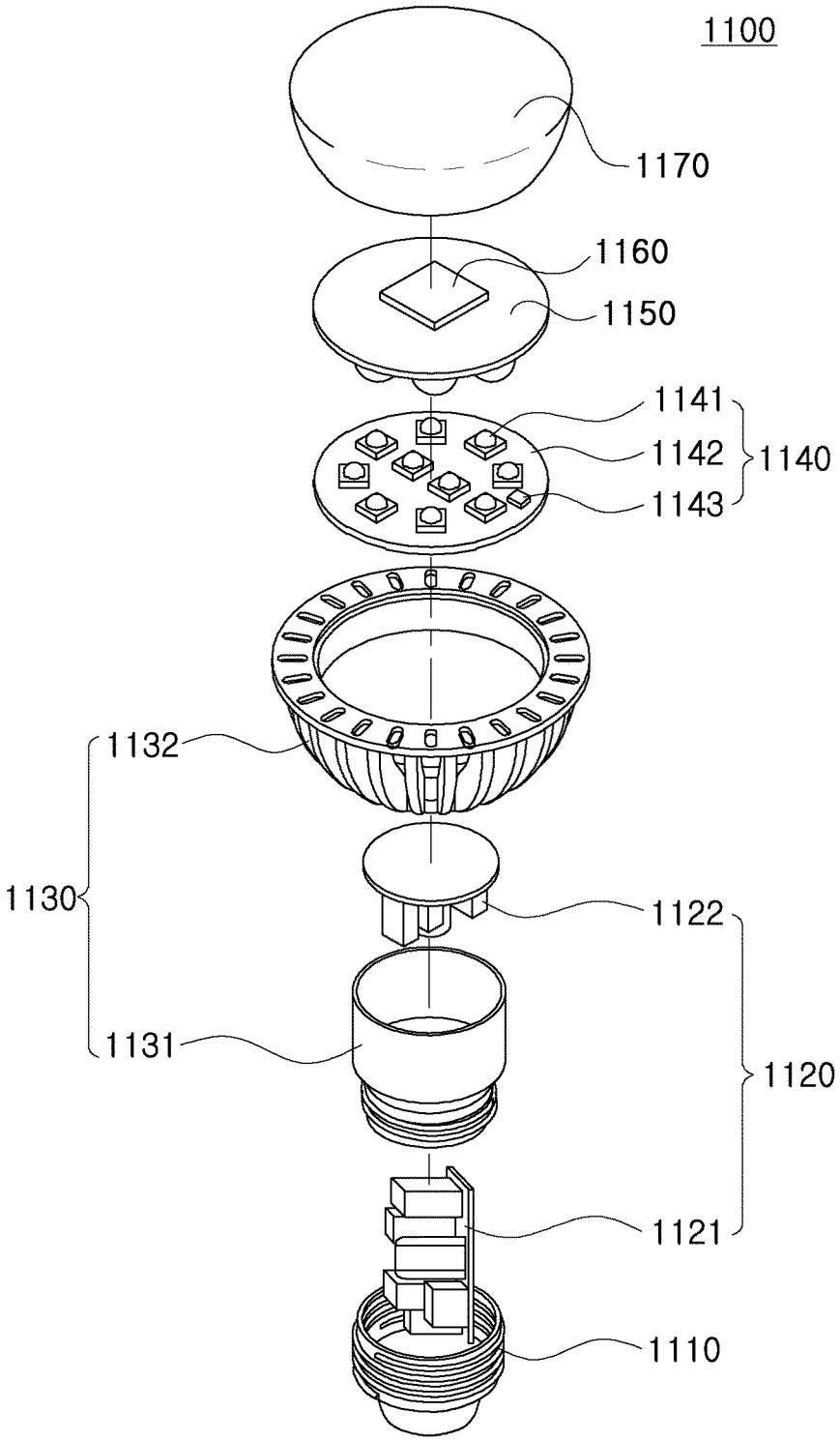
FIG. 12 is an exploded perspective view schematically illustrating a bulb-type lamp as a lighting apparatus to which an LED driving apparatus, according to an example embodiment may be applied.

FIG. 12 is a schematic exploded perspective view of a bulb-type lamp as a lighting apparatus to which a semiconductor light emitting device, according to an example embodiment may be applied.

With reference to FIG. 12, a lighting apparatus 1100 may include a socket 1110, a driving circuit 1120, a heat radiating unit 1130, a light source 1140, and an optical unit. According to an example embodiment, the light source 1140 may include a light emitting device array, and the driving circuit 1120 may include a rectifier circuit and a DC-DC converter or a directly connected AC driving circuit, and the like. A reflecting plate 1150 may be disposed in an upper part of the light source 1140, and the reflecting plate 1150 allows light from the light source 1140 to be uniformly dispersed to the side and the rear, whereby glare may be reduced.

The socket 1110 may be configured to replace an existing lighting apparatus. Electrical power supplied to the lighting apparatus 1100 may be applied through the socket 1110. As illustrated, the driving circuit 1120 may include a first circuit unit 1121 and a second circuit unit 1122 separated from and coupled to each other. The heat radiating unit 1130 may include an internal heat radiating unit 1131 and an external heat radiating unit 1132. The internal heat radiating unit 1131 may be directly connected to the light source 1140 and/or the driving circuit 1120, by which heat may be transferred to the external heat radiating unit 1132. The optical unit may include an internal optical unit (not shown) and an external optical unit (not shown), and may be configured such that light emitted from the light source 1140 may be uniformly dispersed.

The light source 1140 may receive electrical power from the driving circuit 1120 and then emit light to the optical unit. The light source 1140 may include at least one light emitting device 1141, a circuit board 1110, and a controller 1143, and the controller 1143 may store driving information of the light emitting devices 1141 therein. The controller 1143 may include a power detection circuit, a control circuit, or the like according to an example embodiment, and may detect electrical power supplied through the socket 1110 and then determine whether a failure has occurred in a plurality of LEDs included in the light source 1140.

A communications module 1160 may be mounted on an upper part of the reflecting plate 1150 and home-network communications may be implemented through the communications module 1160. For example, the communications module 1160 may be a wireless communications module using Zigbee®, Wi-Fi, or Li-Fi, and may control illumination of a lighting apparatus installed indoors or outdoors, such as on/off operations, brightness adjustment, or the like through a smartphone or a wireless controller. In addition, electronic product systems located indoors or outdoors, such as a TV, a refrigerator, an air conditioner, a door lock, or the like, as well as a vehicle, may be controlled by using a Li-Fi communications module using light having a visible wavelength of a lighting apparatus installed indoors or outdoors.

The reflecting plate 1150 and the communications module 1160 may be covered by a cover unit 1170. On the other hand, the communications module 1160 may be implemented as a controller 1143 and one integrated circuit. In addition, the controller 1143 may be provided as a module separate from the light source 1140.

Figure 13:
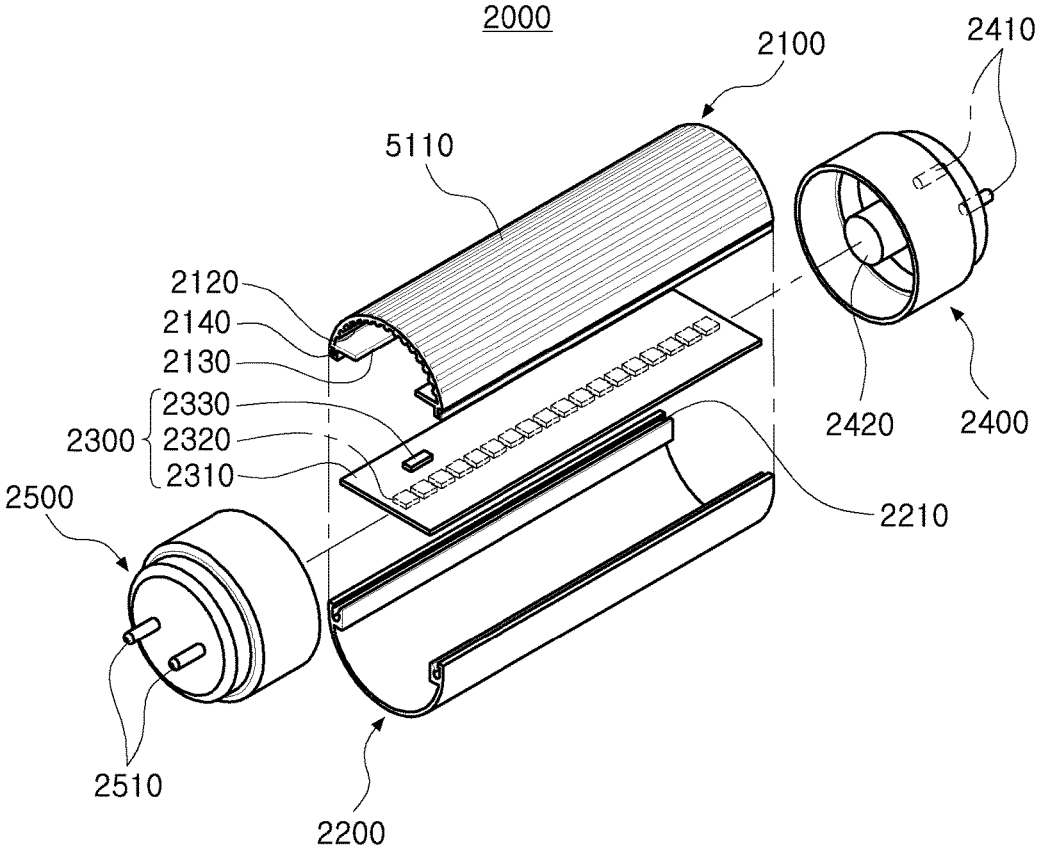
FIG. 13 is an exploded perspective view schematically illustrating a bar type lamp as a lighting apparatus to which an LED driving apparatus, according to an example embodiment may be applied.

FIG. 13 is a schematic exploded perspective view of a bar type lamp as a lighting apparatus to which a semiconductor light emitting device, according to an example embodiment may be applied.

In detail, a lighting apparatus 2000 includes a heat radiating member 2100, a cover 2200, a light source module 2300, a first socket 2400, and a second socket 2500. A plurality of radiating fins 2110 and 2120 having a concave-convex form may be formed on an inner surface or/and an external surface of the heat radiating member 2100, and the heat radiating fins 2110 and 2120 may be designed to have various forms and intervals therebetween. A support portion 2130 having a protruding form is formed inwardly of the heat radiating member 2100. The light source module 2300 may be fixed to the support portion 2130. A stop protrusion 2140 may be formed on two ends of the heat radiating member 2100.

The cover 2200 may include a stop groove 2210 formed therein, and the stop groove 2210 may be coupled to the stop protrusion 2140 of the heat radiating member 2100 in a hook coupling structure. Positions in which the stop groove 2210 and the stop protrusion 2140 are formed may be changed inversely.

The light source module 2300 may include a light emitting device array. The light source module 2300 may include a printed circuit board 2310, light sources 2320, and a controller 2330. As described above, the controller 2330 may store driving information about the light sources 2320 therein. The printed circuit board 2310 may be provided with circuit wirings formed therein, for operating the light sources 2320. In addition, constituent elements for operating the light sources 2320 may be included. The controller 2330 may detect electrical power transferred through sockets 2400 and 2500, and compare the same with a predetermined reference power magnitude range. Thus, the controller 2330 may determine whether a failure has occurred in a plurality of LEDs included in the light source 2320.

The first and second sockets 2400 and 2500 may be provided as a pair of sockets and may have a structure in which they are coupled to two ends of a cylindrical cover unit consisting of the heat radiating member 2100 and the cover 2200. For example, the first socket 2400 may include electrode terminals 2410 and a power supply device 2420, and the second socket 2500 may include dummy terminals 2510 disposed thereon. In addition, an optical sensor and/or a communications module may be disposed inside either of the first socket 2400 or the second socket 2500. For example, the optical sensor and/or the communications module may be disposed within the second socket 2500 in which the dummy terminals 2510 are disposed. As another example, an optical sensor and/or a communications module may be disposed within the first socket 2400 in which the electrode terminals 2410 are disposed.

Figure 14:
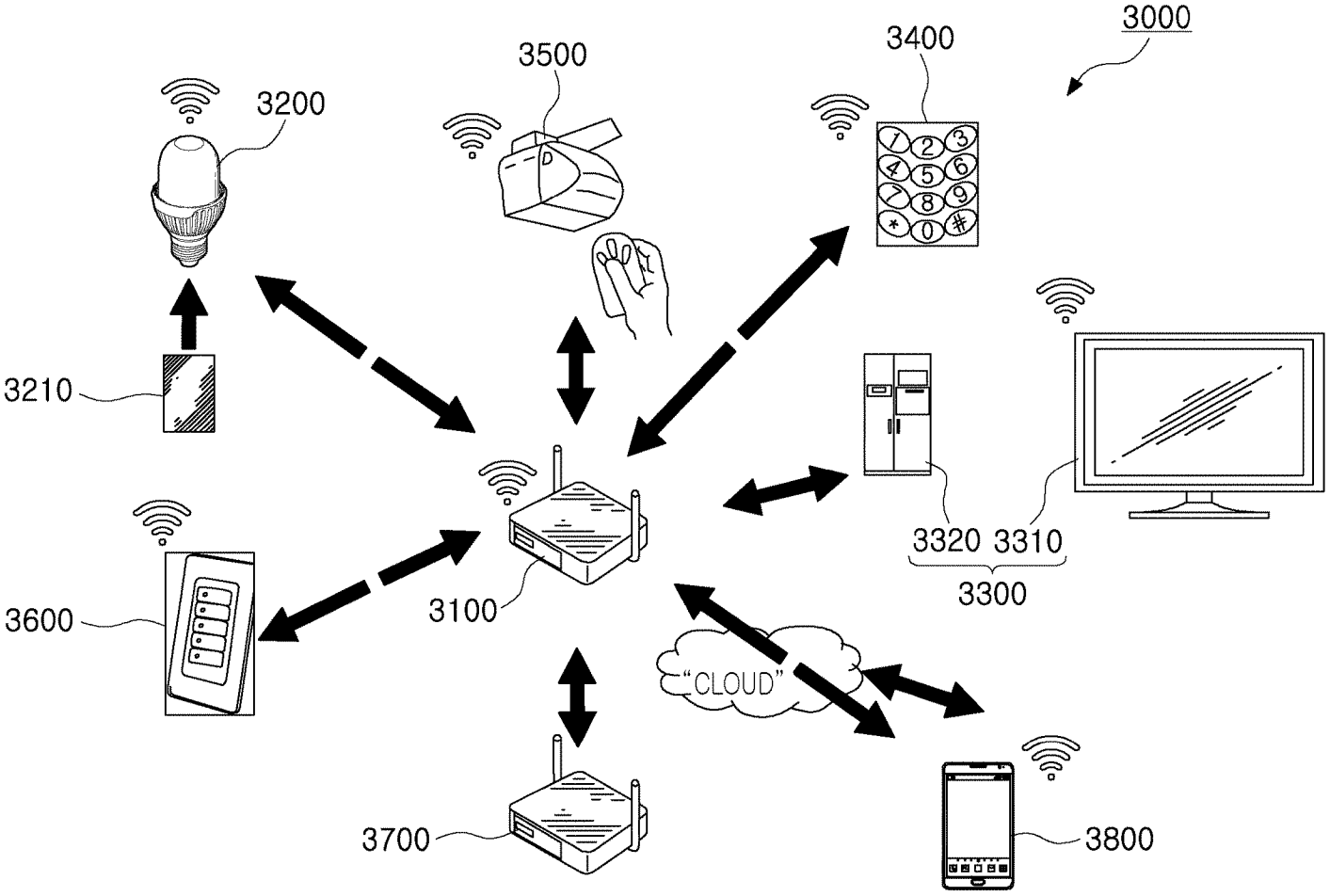
FIGS. 14-16 are schematic diagrams illustrating a lighting control network system to which a lighting apparatus, according to example embodiments may be applied.
Figure 16:
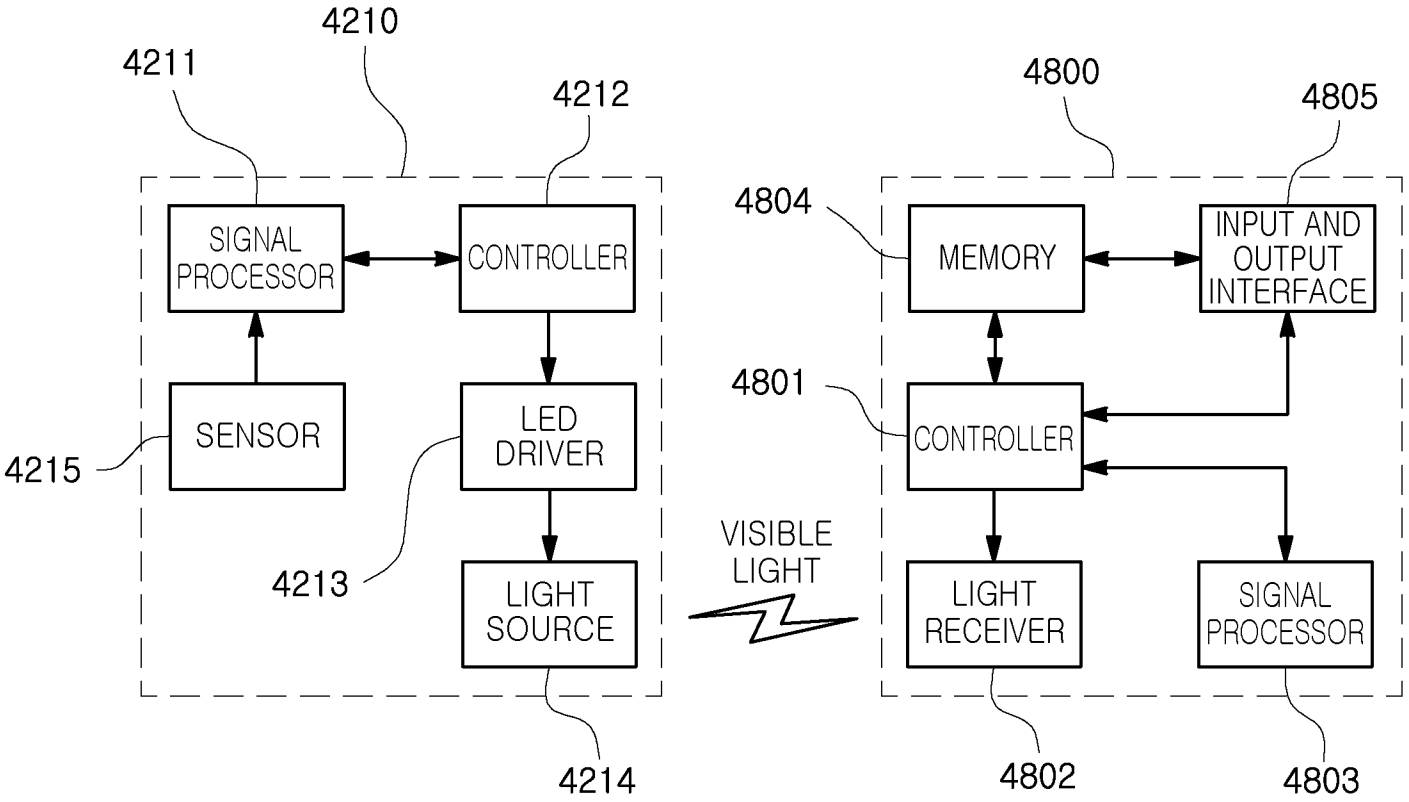

FIGS. 14 and 16 are schematic diagrams illustrating a lighting control network system to which a semiconductor light emitting device, according to example embodiments may be applied.

FIG. 14 is a schematic diagram illustrating an indoor lighting control network system.

According to an example embodiment, a network system 3000 may be a convergence smart lighting-network system in which lighting technology using a light emitting device such as LEDs or the like, Internet of Things (IoT) technology, wireless communications technology, and the like converge with one other. The network system 3000 may be implemented using various lighting apparatuses and a wired and wireless communications device, and implemented by a sensors, a controller, a communications means, software for network control and maintenance, or the like.

The network system 3000 may not only be applied to a closed space defined within a building such as a house or an office, but also to an open space such as a park, a street, or the like. The network system 3000 may be implemented based on an Internet of Things environment in order to collect/process various types of information and to provide the same for a user. In this case, an LED lamp 3200 included in the network system 3000 may serve a role in not only receiving information on the surroundings from a gateway 3100 to control lighting of the LED lamp 3200, but also checking and controlling an operational state of other devices 3300 to 3800 included in the Internet of Things environment, based on a function such as visible light communications of the LED lamp 3200.

With reference to FIG. 14, the network system 3000 may include the gateway 3100 for processing data transmitted and received according to different communications protocols, an LED lamp 3200 connected to the gateway 3100 to communicate therewith and including an LED light emitting device, and a plurality of devices 3300 to 3800 connected to the gateway 3100 to communicate therewith according to various wireless communications methods. For implementing the network system 3000 based on the Internet of Things environment, respective devices 3300 to 3800 as well as the LED lamp 3200 may include at least one communications module. As an example embodiment, the LED lamp 3200 may be connected to the gateway 3100 to communicate therewith by a wireless communications protocol such as Wi-Fi, Zigbee®, Li-Fi, or the like. To this end, the LED lamp 3200 may include at least one communications module 3210 for a lamp.

As described above, the network system 3000 may not only be applied to a closed space such as a home, an office, and the like but also to an open space such as streets or a park. For example, when the network system 3000 is applied to a home, the plurality of devices 3300 to 3800 included in the network system 3000 and connected to the gateway 3100 based on Internet of Things technology to communicate therewith may include household appliances 3300, digital door locks 3400, garage door locks 3500, switches 3600 for lighting installed on a wall or the like, routers 3700 for repeating a wireless communications network, and mobile devices 3800 such as a smartphone, a tablet PC, a laptop computer, and the like.

In the network system 3000, the LED lamp 3200 may check an operational state of various devices 3300 to 3800 by using a wireless communications network (Zigbee®, Wi-Fi, Li-Fi, or the like) installed in a home, or may automatically control illumination of the LED lamp 3200 itself according to the surrounding environment/situation. In addition, the devices 3300 to 3800 included in the network system 3000 may be controlled by using a Li-Fi communications using visible light emitted from the LED lamp 3200.

First, the LED lamp 3200 may automatically control illumination of the LED lamp 3200 based on information on a surrounding environment transferred from the gateway 3100 through a communications module 3210 for a lamp, or information on a surrounding environment collected from a sensor mounted on the LED lamp 3200. For example, lighting brightness of the LED lamp 3200 may be automatically controlled according to a type of program broadcast on a TV 3310 or brightness of a screen. To this end, the LED lamp 3200 may receive information on operation of the TV 3310 from the communications module 3210 for a lamp connected to the gateway 3100. The communications module 3210 for a lamp may be modularized to be integrated with a sensor and/or controller included in the LED lamp 3200.

For example, in a case in which a type of program broadcast on a TV is a drama; according to a preset setting value, a color temperature of lighting may be lowered to be equal to or less than 12000K, for example, 5000K, and a color may also be controlled, whereby a cozy atmosphere may be created. In a case in which a program is a comedy program, the network system 3000 may be configured in such as manner that a color temperature of lighting may be increased to 5000K or higher according to a lighting intensity setting value and adjusted to be bluish-white lighting.

In addition, when a predetermined period of time has elapsed after a digital door lock 3400 has been locked in a state of absence of people from a house, all turned-on LED lamps 3200 may be turned-off, whereby electricity wastage may be prevented. In addition, in a case in which a security mode is set through the mobile device 3800 or the like, when the digital door lock 3400 is locked in a state of absence of people in a house, a turn-on state of the LED lamps 3200 may be maintained.

Operations of the LED lamp 3200 may be controlled according to a surrounding environment collected through various sensors connected to the network system 3000. For example, when the network system 3000 is implemented inside a building, lighting, a position sensor, and a communications module are coupled inside the building, and location information of people inside the building is collected, to turn on or off lighting, or collected information may be provided in real time. Therefore, facility management, the use of idle space, or the like may be efficiently carried out. A lighting apparatus such as the LED lamp 3200 is generally disposed in almost all of the space of a building on respective floors thereof, whereby various types of information inside the building may be collected through a sensor provided integrally with the LED lamp 3200, which may be used for facility management, using idle space, or the like.

On the other hand, the LED lamp 3200 may be coupled to an image sensor, a storage device, a communications module 3210 for a lamp, and the like, and thus, may be used as a device capable of maintaining building security or detecting and reacting to an emergency situation. For example, when a smoke or temperature detecting sensor or the like is attached to the LED lamp 3200, an outbreak of fire or the like may be quickly detected, whereby damage may be significantly reduced. In addition, in consideration of weather, degree of sunlight, or the like, brightness of lighting may be adjusted, thereby providing energy saving, and a pleasant lighting environment.

As described above, the network system 3000 may not only be applied to a closed space such as a home, an office, a building, or the like, but also an open space such as a street, a park, or the like. When the network system 3000 is applied to the open space with no physical limitations, it may be relatively difficult to implement the network system 3000 due to distance limitations of wireless communications, communications interference according to various obstacles, and the like. A sensor, a communications module, and the like are mounted on relative lighting fixtures, and the relative lighting fixtures are used as an information collecting means and a communications repeating means. Thus, the network system 3000 may be efficiently implemented in the above open environment. Hereinafter, it will be described with reference to FIG. 15.

Figure 15:
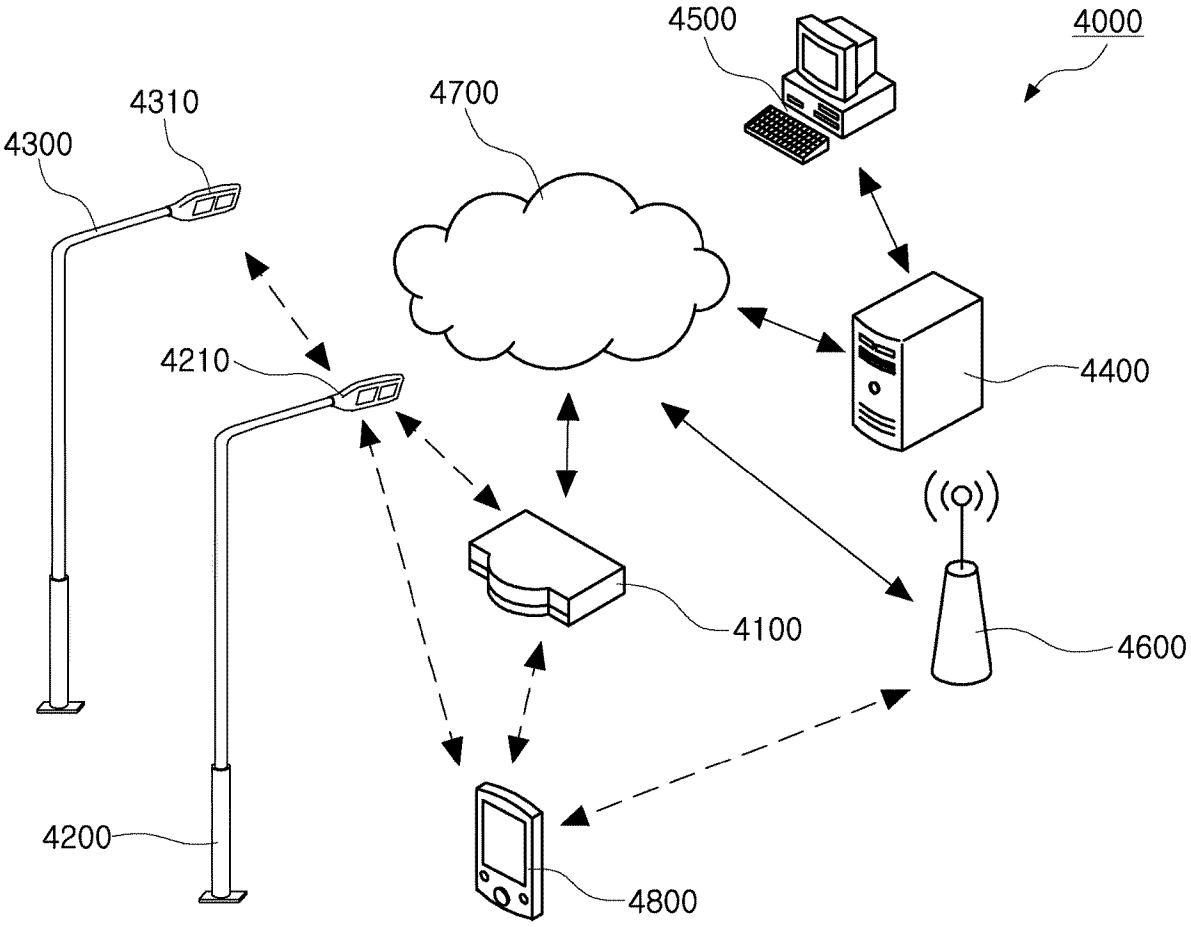

FIG. 15 illustrates an example embodiment of a network system 4000 applied to an open space. With reference to FIG. 15, the network system 4000 according to the example embodiment may include a communications connection device 4100, a plurality of lighting fixtures 4200 and 4300 installed at predetermined intervals to be connected to the communications connection device 4100 to communicate therewith, a server 4400, a computer 4500 managing the server 4400, a communications base station 4600, a communications network 4700 connecting the communications available devices to one another, a mobile device 4800, and the like.

A plurality of lighting fixtures 4200 and 4300 installed in an open outdoor space such as a street, a park, or the like may include smart engines 4210 and 4310, respectively. The smart engines 4210 and 4310 may include a light emitting device emitting light, a sensor collecting information of a surrounding environment in addition to a driving circuit driving a light emitting device, a communications module, and the like. The smart engines 4210 and 4310 may communicate with other peripheral devices according to a communications protocol such as Wi-Fi, Zigbee®, Li-Fi, or the like by the communications module.

In one example, one smart engine 4210 may be connected to another smart engine 4310 to communicate therewith. In this case, Wi-Fi expansion technology (Wi-Fi Mesh) may be applied to communications between the smart engines 4210 and 4310. At least one smart engine 4210 may be connected to the communications connection device 4100 connected to the communications network 4700 by wired/wireless communications. To improve the efficiency of communications, several smart engines 4210 and 4310 may be grouped, and then connected to a single communications connection device 4100.

The communications connection device 4100 may be an access point (AP) to wired/wireless communicate, and may communicate between the communications network 4700 and other devices. The communications connection device 4100 may be connected to the communications network 4700 by at least one of wired/wireless manners. For example, the communications connection device 4100 may be mechanically accommodated inside either of the lighting fixtures 4200 or 4300.

The communications connection device 4100 may be connected to the mobile device 4800 through a communications protocol such as Wi-Fi or the like. A user of the mobile device 4800 may receive information on a surrounding environment collected by a plurality of the smart engines 4210 and 4310 through the communications connection device 4100 connected to the smart engine 4210 of the surrounding lighting fixture 4200 adjacent to the user of the mobile device 4800. The information on a surrounding environment may include surrounding traffic information, weather information, and the like. The mobile device 4800 may be connected to the communications network 4700 in a wireless cellular communications manner such as 3G, 4G, or the like through the communications base station 4600.

On the other hand, the server 4400 connected to the communications network 4700 may receive information collected by the smart engines 4210 and 4310 mounted on the lighting fixtures 4200 and 4300, respectively, and may monitor an operational state and the like of the respective lighting fixtures 4200 and 4300 at the same time. The server 4400 may be connected to the computer 4500 to manage the respective lighting fixtures 4200 and 4300 based on a result of monitoring an operational state of the respective lighting fixtures 4200 and 4300. The computer 4500 may execute software or the like capable of monitoring and managing an operational state of the respective lighting fixtures 4200 and 4300, and the smart engines 4210 and 4310.

For transferring information collected by the smart engines 4210 and 4310 to the mobile device 4800 of a user, various communications manners may be applied. With reference to FIG. 15, through the communications connection device 4100 connected to the smart engines 4210 and 4310, information collected by the smart engines 4210 and 4310 may be transmitted to the mobile device 4800, or the smart engines 4210 and 4310 may be directly connected to the mobile device 4800 to communicate therewith. The smart engines 4210 and 4310 and the mobile device 4800 are directly communicated with each other by visible light wireless communications (Li-Fi). Hereinafter, an embodiment of the present invention is described with reference to FIG. 16.

FIG. 16 is a block diagram describing communications operation of a smart engine 4210 of a lighting fixture 4200 and a mobile device 4800 by visible light wireless communications (Li-Fi). With reference to FIG. 16, a smart engine 4210 may include a signal processing unit 4211, a controller 4212, an LED driver 4213, a light source 4214, a sensor 4215, and the like. A mobile device 4800 connected to the smart engine 4210 by the visible light wireless communications may include a controller 4801, a light receiving unit 4802, a signal processing unit 4803, a memory 4804, an input and output unit 4805, and the like.

Visible light wireless communications (Li-Fi) technology is wireless communications technology capable of wirelessly transferring information using light in a visible light wavelength band, which is light perceptible to the human eye. The visible light wireless communications technology may be distinguished from the existing wire optical communications technology and infrared light wireless communications in the way that light in a visible light wavelength band, in other words, a specific visible light frequency from a light emitting package described in the example embodiment, is used, and may be distinguished from wired optical communications technology in the way that a communications environment is wireless. In addition, visible light wireless communications technology has, unlike RF wireless communications, convenience for freely using without restriction or authorization in terms of use of frequency, excellent physical security, and differentiation for allowing a user to visually confirm a communications link. Further, the visible light wireless communications technology has features of convergence technology capable of obtaining a unique purpose of a light source and a communications function at the same time.

With reference to FIG. 16, a signal processor 4211 of the smart engine 4210 may process data to be transmitted and received by visible light wireless communications. As an example embodiment, the signal processor 4211 may process information collected by the sensor 4215 as data and may transmit the processed information to the controller 4212. The controller 4212 may control operations of the signal processor 4211, the LED driver 4213, and the like, and, may also control operations of the LED driver 4213 based on data transmitted by the signal processor 4211. The LED driver 4213 may allow the light source 4214 to emit light in response to a control signal transferred by the controller 4212, such that data may be transferred to the mobile device 4800.

The mobile device 4800 may include a controller 4801, a memory 4804 storing data therein, a display device and a touch screen, an input and output interface 4805 including an audio output interface, and the like, a signal processor 4803, and a light receiver 4802 detecting visible light including data signals. The light receiver 4802 may detect and convert visible light into an electronic signal, and the signal processor 4803 may decode data included in the electronic signal converted by the light receiver. The controller 4801 may store data decoded by the signal processing unit 4803 in the memory 4804, or output the data to allow a user to recognize the output data through the input and output interface 4805 or the like.

As set forth above, according to example embodiments, the LED driving apparatus may determine a failure of an LED and/or the LED driving apparatus by detecting a magnitude of input power, thereby controlling output power supplied to the LED by the LED driving apparatus. In detail, when an abnormal state has occurred in an LED, output power may be blocked or output power may be increased or decreased, whereby a damage to the LED and the LED driving apparatus may be mitigated, and stable operations may be secured. In addition, a power consumption monitoring function of the LED driving apparatus may be provided through a power detection circuit.

The operations or steps of the methods or algorithms described above can be embodied as computer readable codes on a computer readable recording medium, or to be transmitted through a transmission medium. The computer readable recording medium is any data storage device that can store data which can be thereafter read by a computer system. Examples of the computer readable recording medium include read-only memory (ROM), random-access memory (RAM), compact disc (CD)-ROM, digital versatile disc (DVD), magnetic tape, floppy disk, and optical data storage device, not being limited thereto. The transmission medium can include carrier waves transmitted through the Internet or various types of communication channel. The computer readable recording medium can also be distributed over network coupled computer systems so that the computer readable code is stored and executed in a distributed fashion.

At least one of the components, elements, modules or units represented by a block as illustrated in FIGS. 1, 2, 3, 5 and 16 may be embodied as various numbers of hardware, software and/or firmware structures that execute respective functions described above, according to an exemplary embodiment. For example, at least one of these components, elements, modules or units may use a direct circuit structure, such as a memory, a processor, a logic circuit, a look-up table, etc. that may execute the respective functions through controls of one or more microprocessors or other control apparatuses. Also, at least one of these components, elements, modules or units may be specifically embodied by a module, a program, or a part of code, which contains one or more executable instructions for performing specified logic functions, and executed by one or more microprocessors or other control apparatuses. Also, at least one of these components, elements, modules or units may further include or may be implemented by a processor such as a central processing unit (CPU) that performs the respective functions, a microprocessor, or the like. Two or more of these components, elements, modules or units may be combined into one single component, element, module or unit which performs all operations or functions of the combined two or more components, elements, modules or units. Also, at least part of functions of at least one of these components, elements, modules or units may be performed by another of these components, elements, modules or units. Further, although a bus is not illustrated in the above block diagrams, communication between the components, elements, modules or units may be performed through the bus. Functional aspects of the above exemplary embodiments may be implemented in algorithms that execute on one or more processors. Furthermore, the components, elements, modules or units represented by a block or processing steps may employ any number of related art techniques for electronics configuration, signal processing and/or control, data processing and the like Further, at least one of the components, elements, modules or units represented by a block as illustrated in FIGS. 1, 2 and 3 may not be limited by the circuits illustrated in FIGS. 4 and 5, and may be embodied in different circuits to perform corresponding functions described herein.

While example embodiments of the inventive concept have been shown and described above, it will be apparent to those skilled in the art that modifications and variations can be made without departing from the scope of the inventive concept as defined by the appended claims.

What is claimed is:

1. A light emitting diode (LED) driving apparatus comprising:

a first circuit connected to a primary winding of a transformer, and configured to receive input power and transfer the input power to the primary winding of the transformer, the first circuit comprising a boost converter;

a second circuit connected to a secondary winding of the transformer to generate output power for driving a plurality of LEDs, the second circuit comprising a switch and a buck converter; and a controller comprising:

a control circuit configured to control the switch of the second circuit to selectively apply the output power to the plurality of LEDs; and a power detection circuit configured to compare a magnitude of the input power with a predetermined reference power magnitude range and transmit a first control command to the control circuit via an isolation circuit, in response to determining that the magnitude of the input power is outside the predetermined reference power magnitude range, wherein the isolation circuit is configured to connect the power detection circuit to the control circuit, and wherein the switch of the second circuit is configured to operate based on the first control command.

2. The LED driving apparatus of claim 1, wherein the switch is interposed between the secondary winding of the transformer and the plurality of LEDs, wherein the power detection circuit transmits a second control command for blocking the output power to the control circuit via the isolation circuit, in response to determining that the magnitude of the input power is outside the predetermined reference power magnitude range, and wherein the switch of the second circuit is configured to open based on the second control command.

3. The LED driving apparatus of claim 1, wherein the switch is interposed between the secondary winding of the transformer and the plurality of LEDs, wherein the power detection circuit transmits a third control command for changing a magnitude of the output power to the control circuit via the isolation circuit, in response to determining that the magnitude of the input power is outside the predetermined reference power magnitude range, and wherein an operating frequency of the switch of the second circuit is controlled by the third control command.

4. The LED driving apparatus of claim 1, wherein the switch is interposed between the secondary winding of the transformer and the plurality of LEDs, wherein the power detection circuit determines that an open defect has occurred in at least a portion of the LEDs and transmit the first control command to the control circuit via the isolation circuit, in response to the magnitude of the input power is less than a lower limit of the predetermined reference power magnitude range, and wherein the switch of the second circuit is configured to open based on the first control command.

5. The LED driving apparatus of claim 1, wherein the switch is interposed between the secondary winding of the transformer and the plurality of LEDs, wherein the power detection circuit determines that a short circuit defect has occurred in at least a portion of the LEDs and transmit the first control command to the control circuit via the isolation circuit, in response to determining that the magnitude of the input power is larger than an upper limit of the predetermined reference power magnitude range, and wherein the switch of the second circuit is configured to open based on the first control command.

6. The LED driving apparatus of claim 1, wherein the power detection circuit is communicatively connected to an external electronic device, and transmits power consumption calculated based on the magnitude of the input power to the external electronic device.

7. The LED driving apparatus of claim 1, wherein the control circuit determines at least one condition among whether a failure has occurred in at least a portion of the LEDs, whether an abnormality has occurred in receiving the input power or in outputting the output power, and whether load variation has occurred in the second circuit, based on the magnitude of the input power.

8. The LED driving apparatus of claim 7, wherein the control circuit is communicatively connected to an external lighting controller by a digital addressable lighting interface communications protocol, and transmits information about the at least one condition to the external lighting controller.

9. The LED driving apparatus of claim 1, wherein the power detection circuit includes a power metering controller.

10. An LED driving apparatus comprising:

a first circuit connected to a primary winding of a transformer, and configured to receive input power and transfer the input power to the primary winding of the transformer, the first circuit comprising a boost converter;

a second circuit connected to a secondary winding of the transformer and configured to generate output power for driving a plurality of LEDs, the second circuit comprising a switch and a buck converter; and a controller configured to control a magnitude of the output power by controlling operations of the second circuit, and connected to an external lighting controller to communicate with the external lighting controller through a digital addressable lighting interface communications protocol, wherein the controller generates information required for lighting control through the digital addressable lighting interface communications protocol by automatically comparing a magnitude of the input power with a predetermined reference power magnitude range, and transmits the information to the external lighting controller, and wherein the external lighting controller is configured to control brightness of the plurality of LEDs by changing an operating frequency of the switch of the second circuit.

11. The LED driving apparatus of claim 10, wherein the controller comprises:

a power detection circuit configured to detect the magnitude of the input power and compare the magnitude of the input power with the predetermined reference power magnitude range;

a control circuit communicatively connected to the external lighting controller to communicate with the external lighting controller; and an isolation circuit configured to connect the power detection circuit to the control circuit.

12. The LED driving apparatus of claim 11, wherein the switch is interposed between the secondary winding of the transformer and the plurality of LEDs, and wherein the power detection circuit determines that an open defect has occurred in at least a portion of the LEDs and controls the switch of the second circuit to open, in response to determining that the magnitude of the input power is less than a lower limit of the predetermined reference power magnitude range.

13. The LED driving apparatus of claim 11, wherein the switch is interposed between the secondary winding of the transformer and the plurality of LEDs, and wherein the power detection circuit determines that a short circuit defect has occurred in at least a portion of the LEDs and controls the switch of the second circuit to open, in response to determining that the magnitude of the input power is greater than an upper limit of the predetermined reference power magnitude range.

14. The LED driving apparatus of claim 11, wherein the switch is interposed between the secondary winding of the transformer and the plurality of LEDs, wherein the power detection circuit transmits a control command to the control circuit through the isolation circuit, in response to determining that the magnitude of the input power is outside the predetermined reference power magnitude range.

15. The LED driving apparatus of claim 10, wherein the controller transmits information about at least one of lamp failure in the LEDs, a power failure in the input power or the output power, and load variation in the second circuit to the external lighting controller through the digital addressable lighting interface communications protocol.

* * * * *